US005240362A

United States Patent [19]

Nakayama et al.

[11] Patent Number: 5,240,362

[45] Date of Patent: Aug. 31, 1993

[54] IMAGE FORMING APPARATUS WITH BOOK BIND DEVICE

[75] Inventors: Tomobumi Nakayama, Tokyo; Shinichi Nakamura; Hisatsugu Tahara, both of Kawasaki; Satoshi Kuroyanagi, Tokyo; Osamu Iwamoto, Kawasaki, all of Japan

[73] Assignee: Canon Kabushiki Kaisha, Tokyo, Japan

[21] Appl. No.: 18,431

[22] Filed: Feb. 16, 1993

Related U.S. Application Data

[63] Continuation of Ser. No. 610,124, Nov. 7, 1990, abandoned.

[30] Foreign Application Priority Data

Nov. 9, 1989 [JP] Japan ..... 1-290100
Nov. 9, 1989 [JP] Japan ..... 1-290103

[51] Int. Cl.[5] ..... B42C 13/00

[52] U.S. Cl. ..... 412/11; 412/18; 412/4; 412/33; 412/37

[58] Field of Search ..... 412/11, 16, 18, 8, 33, 412/37, 4

[56] References Cited

U.S. PATENT DOCUMENTS

| | | | |
|---|---|---|---|
| 4,134,672 | 1/1979 | Burlew et al. | 412/33 X |
| 4,339,299 | 7/1982 | Snellman et al. | 412/37 X |
| 4,507,037 | 3/1985 | Fenimore | 412/11 |
| 4,564,185 | 1/1986 | Hamlin et al. | 412/33 X |
| 4,610,590 | 9/1986 | Pigna | 412/11 |
| 4,626,156 | 12/1986 | Baughman et al. . | |
| 4,825,250 | 4/1989 | Miyata et al. | 355/14 R |
| 4,958,974 | 9/1990 | Schenk | 412/8 X |

FOREIGN PATENT DOCUMENTS

| | | |
|---|---|---|
| 60-183461 | 9/1985 | Japan . |
| 2141666 | 6/1984 | United Kingdom . |

*Primary Examiner*—Mark Rosenbaum
*Assistant Examiner*—Willmon Fridie, Jr.
*Attorney, Agent, or Firm*—Fitzpatrick, Cella, Harper & Scinto

[57] ABSTRACT

A book bind device has a supplier for supplying a front sheet used in a book bind operation of sheet members, a conveyor for guiding a plurality of sheet members on which an image is formed into the front sheet, and book binder for performing the book binding operation by coupling the supplied front sheet and the bundle of sheet members therein.

32 Claims, 25 Drawing Sheets

| |
|---|
| FIG. 9A-1 |
| FIG. 9A-2 |

| |
|---|
| FIG. 9E-1 |
| FIG. 9E-2 |

FIG. 10

| DATA CONTENT | |
|---|---|
| 1 | 601 BIND MODE FLAG |
| 0 | 602 MANUAL BIND MODE FLAG |
| 0 | 603 GROUP MODE FLAG |
| 0 | 604 SORT MODE FLAG |
| 0 | 605 NORMAL MODE FLAG |
| 5 | 606 NUMBER OF ORIGINAL |
| 001 | 607 SIZE OF ORIGINAL |
| 2 | 608 COPY NUMBER |
| 500 | 609 THICKNESS DATA |
| 001 | 610 FRONT SHEET DATA |
| 1 | 611 LEFT BIND MODE FLAG |
| 0 | 612 SINGLE BIND MODE FLAG |
| 0 | 619 START FLAG |
| — | 618 SET FRONT PAGE |
| — | 613 EMPTY FLAG |
| — | 614 END FLAG |
| 000000001 | 615 FRONT SHEET SIZE AND THICKNESS CODE OF UPPER STAGE |
| 000001001 | 616 FRONT SHEET SIZE AND THICKNESS CODE OF INTERMEDIATE STAGE |
| 000010001 | 617 FRONT SHEET SIZE AND THICKNESS CODE OF LOWER STAGE |
| | |

FIG. 11

| POSITION 8 | 7 | 6 | | 5 | 4 | 3 | | 2 | 1 | 0 | |
|---|---|---|---|---|---|---|---|---|---|---|---|
| PRESENCE/ ABSENCE | FRONT SHEET COLOR CODE | | | FRONT SHEET THICKNESS CODE | | | | FRONT SHEET SIZE CODE | | | |
| 0 PRESENCE | 0 | 0 | WHITE | 0 | 0 | 0 | 1～5 SHEETS | 0 | 0 | 0 | A4 |
| 1 ABSENCE | 0 | 1 | BLACK | 0 | 0 | 1 | 5～10 SHEETS | 0 | 0 | 1 | A4R |
| | 1 | 0 | RED | 0 | 1 | 0 | 11～20 SHEETS | 0 | 1 | 0 | B5 |
| | 1 | 1 | BLUE | 0 | 1 | 1 | 21～30 SHEETS | 0 | 1 | 1 | B5R |
| | | | | 1 | 0 | 0 | 31～40 SHEETS | 1 | 0 | 0 | B4 |
| | | | | 1 | 0 | 1 | 41～50 SHEETS | 1 | 0 | 1 | B4R |
| | | | | 1 | 1 | 0 | 51～60 SHEETS | 1 | 1 | 0 | A3 |
| | | | | 1 | 1 | 1 | 61～70 SHEETS | 1 | 1 | 1 | A3R |

IMAGE FORMING APPARATUS WITH BOOK BIND DEVICE

This application is a continuation of application Ser. No. 07/610,124 filed Nov. 7, 1990 now abandoned.

BACKGROUND OF THE INVENTION:

1. Field of the Invention

The present invention relates to a book bind device for binding a bundle of recording sheets subjected to image recording by an image forming or recording apparatus such as a copying machine with a front sheet, and an image forming apparatus comprising the book bind device.

2. Related Background Art

Conventionally, as post-treatment apparatuses for an image forming apparatus such as a copying recording apparatus, a sorter which can store recorded transfer sheets (recording sheets) on bins in correspondence with a plurality of bundles of an originals, a staple for stapling a bundle of transfer sheets, and the like are known.

However, no book bind device for binding a bundle of transfer sheets with a front sheet has been proposed yet.

In a versatile book bind device which has been conventionally proposed, prints to be bound must be manually bound with a front sheet, and must then be manually inserted in a bind mechanism. In this manner, the conventional book bind device cannot be operated in direct cooperation with an image forming apparatus.

SUMMARY OF THE INVENTION

It is an object of the present invention to provide a book bind device which can execute a book bind treatment for automatically binding transfer sheets with a front sheet in cooperation with an image forming apparatus main body, and an image forming apparatus.

In order to achieve the above object, a book bind device according to the present invention has a path for guiding a sheet subjected to image formation to a book binding unit and a path for guiding a front sheet to the book binding unit.

A book bind device of the present invention comprises first convey means for conveying a plurality of recording sheets discharged from an image forming apparatus, deposit means for temporarily storing the plurality of recording sheets conveyed by the first convey means, front sheet storing means for storing front sheets used in a book bind operation of the recording sheets, second convey means for conveying the bundle of recording sheets in the deposit means, third convey means for conveying a front sheet stored in the front sheet storing means, and book bind means for binding the bundle of recording sheets conveyed by the second convey means with the front sheet conveyed by the third convey means.

According to the present invention, a book bind treatment can be automatically executed in cooperation with the image forming apparatus.

According to the present invention, after recording sheets are discharged from the image forming apparatus and are stored in the deposit means, the stored bundle of recording sheets are bound with the front sheet stored in the front sheet storing means. Therefore, the book bind treatment can be automatically executed in cooperation with the image forming apparatus.

As temporary bind means, a staple device may be used to allow secure temporary binding of recording sheets.

The book bind device can operate in a first mode for directly conveying the recording sheets to the book bind means, and in a second mode for conveying the recording sheets to the deposit means and then binding the recording sheets. Therefore, an optimal mode can be selected according to a book bind treatment time and book bind quality.

Since a convey path is automatically selected according to the number of recording sheets, a book bind treatment of a small number of recording sheets can be performed at high speed while maintaining high book bind quality.

When a large number of recording sheets are to be bound, the recording sheets are divided into a plurality of bundles, and these bundles are time-serially conveyed to the book bind means. Thus, no large-scale convey path is required.

The book bind device of the present invention also comprises clamping means for clamping the front sheet and the bundle of recording sheets conveyed by the convey means, heating means for heating twice the front sheet and the bundle of recording sheets clamped by the clamping means, and control means for pressurizing the front sheet and the bundle of recording sheets by decreasing a clamping interval of the clamping means during the second heating to be smaller than that during the first heating of the heating means. Therefore, a glue can be uniformly spread to the entire glue portion during the first heating treatment, and the front sheet and the recording sheets are heated in a pressurizing state during the second heating treatment, thus increasing the adhesion properties of the glue.

The control means receives an information signal indicating a total thickness of the front sheet and the bundle of recording sheets, and varies the clamping interval of the clamping means on the basis of the thickness information of the received information signal, thus allowing book bind treatments of various types of recording sheet.

The clamping means has a projecting member on a surface which is in contact with the front sheet. Therefore, since specific portions of the recording sheets and the front sheet are pressurized, adhesion properties between the recording sheets and the front sheet can be increased.

BRIEF DESCRIPTION OF THE DRAWINGS

FIGS. 9A to 9F, 9A1, 9A2, 9E1, 9E2, are flow charts showing treatment operations executed in the book bind device;

Figure 12:
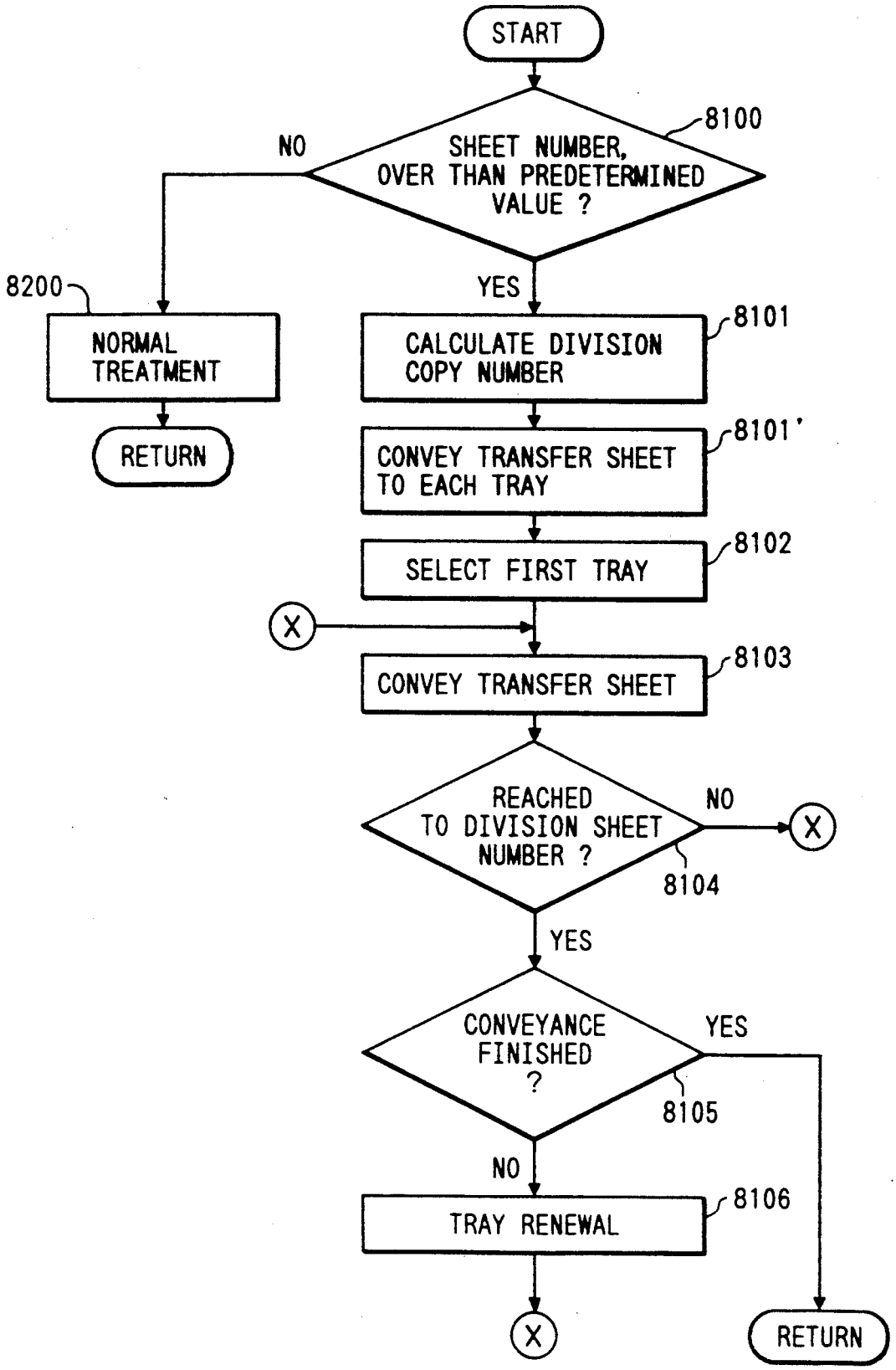
Figure 13:
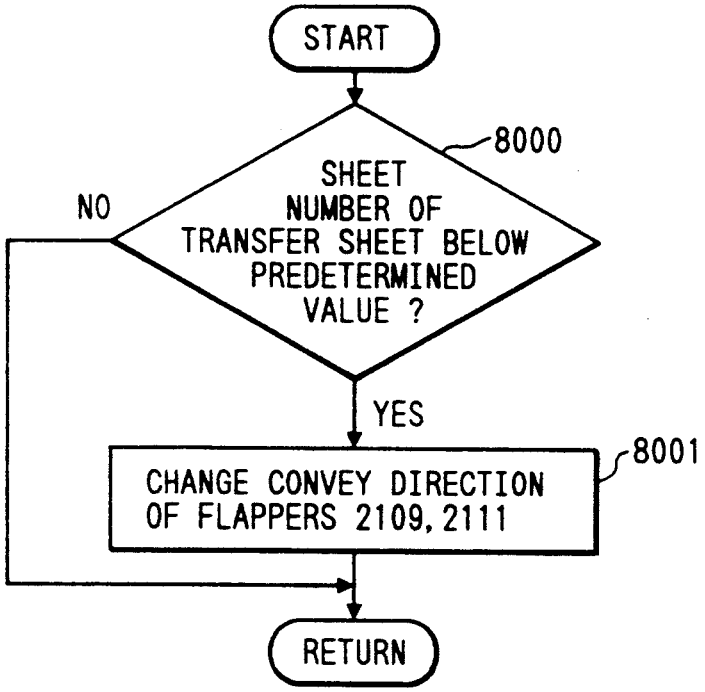

FIG.. 10 is an explanatory view showing the types of information to be transferred from the copying machine to the book bind device;

FIG. 11 is an explanatory view showing a data format of front sheet data 610 shown in FIG. 10;

FIG. 12 is a flow chart showing a treatment operation in a book bind device according to the second embodiment of the present invention; and FIG. 13 is a flow chart showing a treatment operation in a book bind device according to the third embodiment of the present invention.

DESCRIPTION OF THE PREFERRED EMBODIMENTS

An embodiment of the present invention will be described below with reference to the accompanying drawings.

Figure 1:
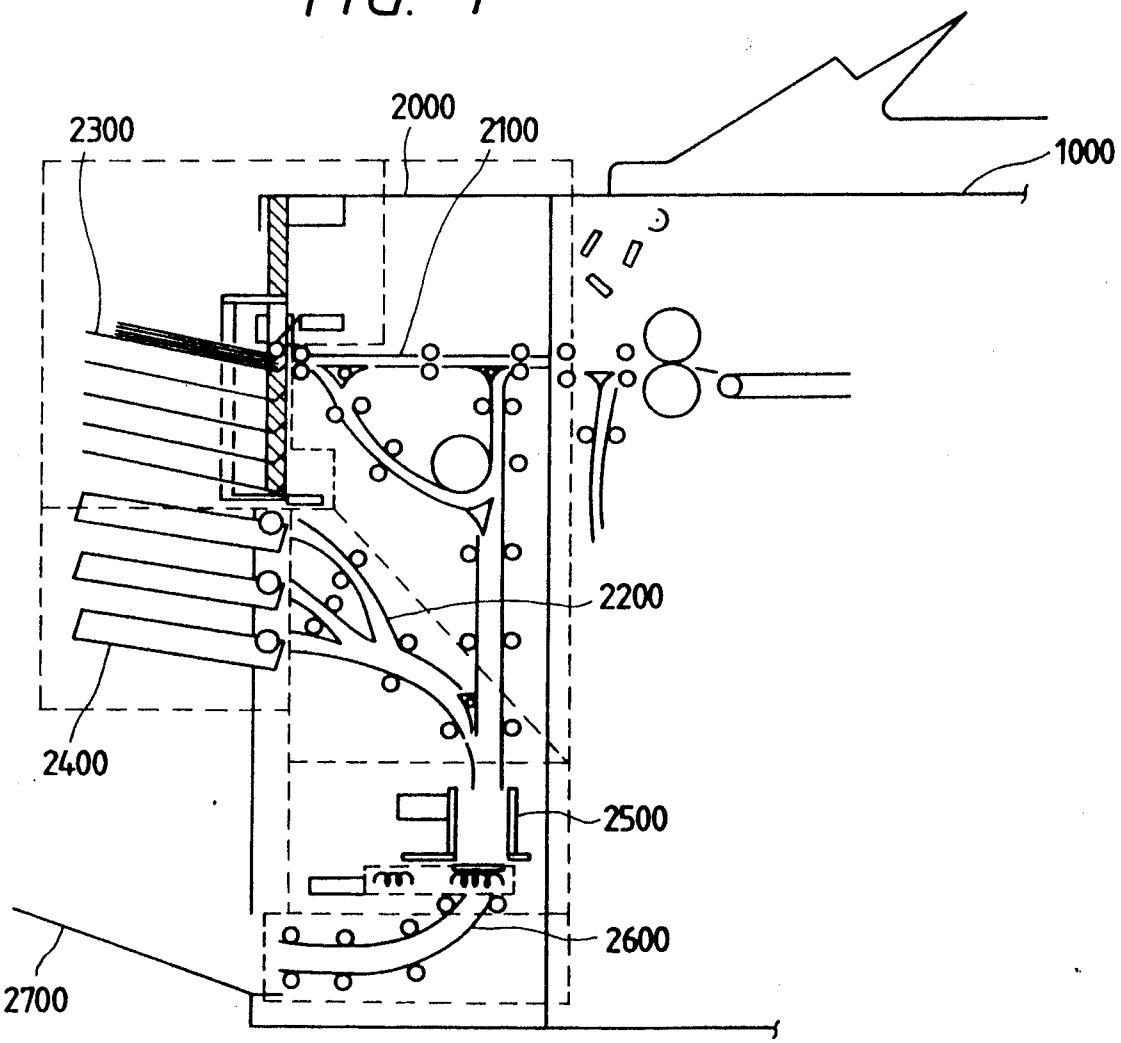
FIG. 1 is a sectional view showing a structure of a main part according to an embodiment of the present invention.

FIG. 1 shows a basic arrangement according to the embodiment of the present invention. In FIG. 1, a book bind device 2000 includes a first convey unit 2100 for conveying a transfer sheet fed from a copying machine, a second convey unit 2200 for supplying a front sheet from a front sheet cassette 2400 to a book bind unit 2500, an exclusive tray (deposit means) 2300 for temporarily storing transfer sheets, the front sheet cassette 2400 for storing front sheets, and the book bind unit 2500 for binding the transfer sheets with the front sheet by gluing. The book bind device also includes a cooling unit 2600 for cooling a heated glued spine of a book, and a book bind tray 2700 for storing the bound transfer sheets. The first and second convey units 2100 and 2200 serve as convey means. The book bind unit 2500 comprises a book binder 2503 serving as a clamping means, and a heating unit 2505 serving as a heating means.

Figure 2:
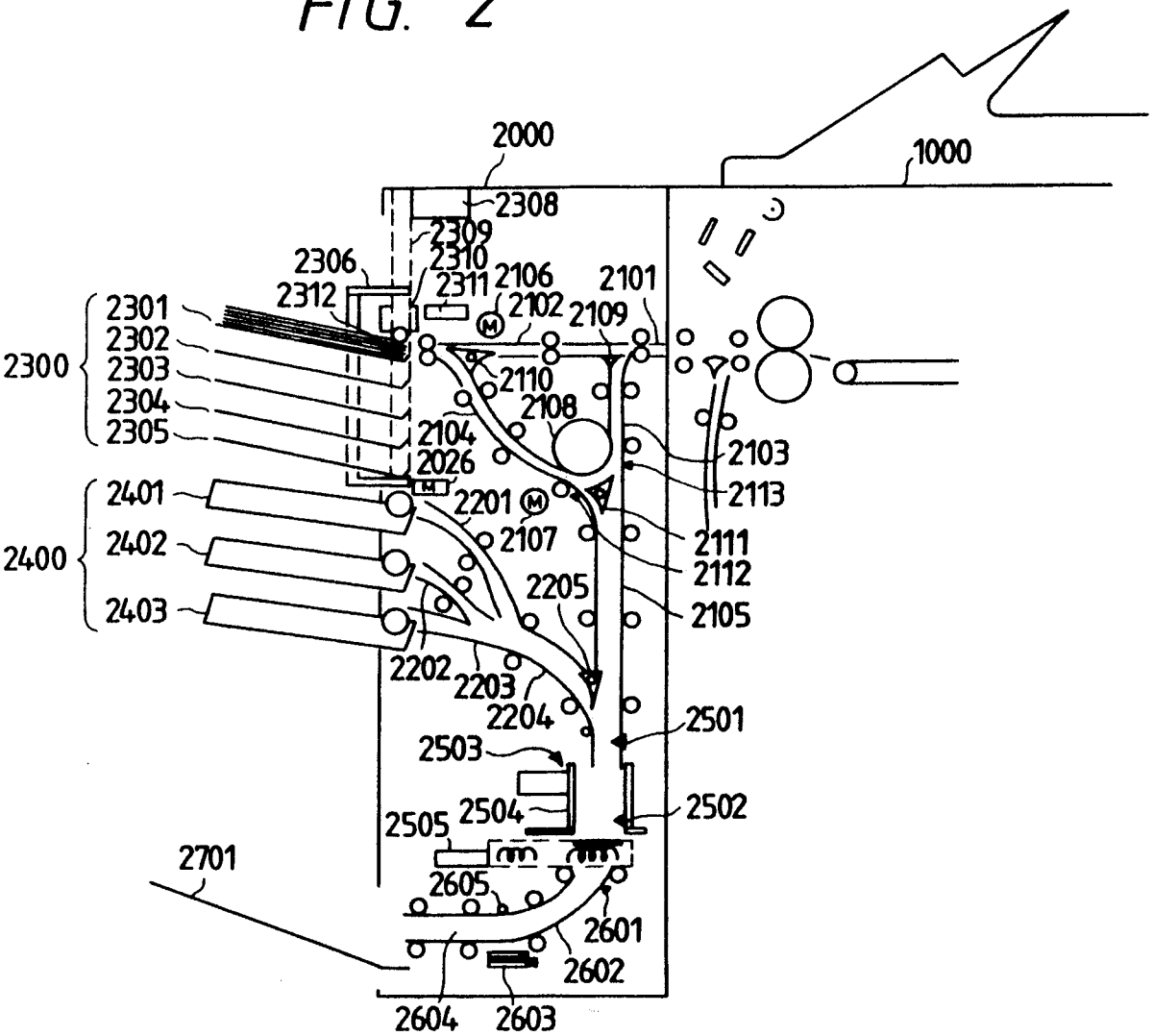
FIG. 2 is a sectional view showing a detailed structure of the main part shown in FIG. 1.

FIG. 2 shows the detailed structure in the respective units of the book bind device 2000 shown in FIG. 1. In FIG. 2, a flapper 2109 switches a convey direction of recorded transfer sheets between a direction of a convey path 2102 and a direction of a convey path 2103. The flapper 2109 is normally set on the convey path 2102 side, and the transfer sheets travel along the convey path 2102. The convey paths 2101 and 2102 are driven by a first convey motor 2106 at the same convey speed as that of the copying machine main body.

A flapper 2110 selectively switches a convey direction between a convey direction to temporary store bins 2301 to 2305 and a convey direction of a convey path 2104. In a state illustrated in FIG. 2, the convey direction of the flapper 2110 is set in the direction of the temporary store bins 2301 to 2305. For this reason, the transfer sheets discharged from a copying machine main body 1000 are conveyed to the temporary store bins.

A sheet re-supply roller 2311 re-supplies a bundle of transfer sheets stored in one of the temporary store bins into the book bind device. When the transfer sheets are conveyed to the above-mentioned temporary store bins, the sheet re-supply roller 2311 escapes to a position above the temporary store bins. When the first page of a second copy of transfer sheets is to be received, the temporary store bin 2302 is shifted upward by one stage by a lead cam 2309 and a motor 2308, and is set along the convey path 2102.

When the second page of a first copy of transfer sheets is to be received, the lead cam 2309 is rotated in the reverse direction to shift the bin 2302 in the reverse direction (downward), thus setting the bin 2301 along the convey path 2102. For example, when two copies of transfer sheets (each copy consists of five sheets) are to be received, the lead cam 2309 is moved under the operation control of the motor, so that the first copy of transfer sheets are received by the temporary store bin 2301 and the second copy of transfer sheets are received by the bin 2302, thus forming bundles of five sheets (pages) by these bins. A swing rod 2306 is arranged to register the side edge portions of these bundles of transfer sheets. The swing rod 2306 is moved by a driving motor 2307 (not shown) to be brought into contact with the transfer sheets, thereby registering the side edge portions of the two bundles.

The bundles of five transfer sheets whose, .edge portions are registered in this manner are stapled (temporarily bound) by a staple device 2310 prior to conveyance. The staple device 2310 escapes from the temporary store bins at times other than in a staple mode. The stapled bundles of transfer sheets are fed onto the convey path 2104 by the sheet re-supply roller 2311.

On the other hand, front sheet cassettes 2401 to 2403 are detachable from the book bind device 2000, and store front sheets of different sizes.

In this embodiment, the cassette 2401 stores front sheets for one to five A4-size sheets per bundle, the cassette 2402 stores front sheets for six to 10 A4-size sheets per bundle, and the cassette 2403 stores front sheets for 11 to 20 A4-size sheets per bundle. For example, in each cassette, a plurality of laid U-shaped front sheets are stacked and deposited, and are separated and fed one by one by, e.g., a suction roller. Alternatively, folded and flattened front sheets may be stored, may be separated one by one in a flat state, and then may be spread in a U-shaped by suction in the book bind unit.

Convey paths 2201 to 2203 for conveying front sheets from the front sheet cassettes 2401 to 2403 merge at a convey path 2204, and convey the front sheets into the book binder 2503.

Each of the convey paths 2201 to 2203 is independently driven by a driving motor 2107, and the convey path to be driven is selected to select a front sheet suitable for a transfer sheet. The driving motor 2107 independently drives not only the convey paths 2201 to 2203 but also the convey paths 2103 to 2105, 2602 and 2604 through a transmission mechanism (not shown).

A front sheet set sensor 2502 arranged in the book binder 2503 detects that the front sheet is conveyed into the book binder 2503, and a heater of the heating unit 2505 is heated to melt a glue applied on the spine of the front sheet via a copper plate 2533 (not shown).

When the arrival of the front sheet is detected by the front sheet set sensor 2502, the sheet re-supply roller 2311 is driven, and the sheet re-supply path flapper 2110 is switched to the convey path 2104 side. For this reason, the stapled bundles of transfer sheets are conveyed from the convey path 2104 to the book binder 2503 via a convey path 2105. A flapper 2111 arranged at a diverging point to the convey paths 2103 and 2104 switches between these convey paths 2103 and 2104, and guides a bundle of transfer sheets whose transfer copy number is a single copy to the book binder 2503 via the convey path 2103. One side surface 2504 of the book binder 2503 is movable, and is positioned so that an interval between itself and the other surface is slightly larger than a total height of a bundle of transfer sheets.

The bundle of transfer sheets and the front sheet set in the book binder 2503 are bound by a melted glue. When the heating unit 2505 is moved to escape, the bound bundle is conveyed to the convey path 2602. A fan 2603 is arranged near the convey path 2604 to cool the bundle conveyed from the convey path 2602 along the convey path 2604 below a predetermined temperature, thereby hardening the glue. The bundle reaching the predetermined temperature is re-conveyed from the convey path 2604 to a book bind tray 2701, and is then discharged.

On the other hand, when the trailing end of the bound bundle is detected by a sensor 2601 arranged near an exit of the book binder 2503, the escaping heating unit 2505 is returned to its home position to prepare for the book bind treatment for the next bundle.

When it is detected that the bound bundle is discharged from the book binder 2503, the bin 2301 which is presently set at the discharge position is shifted upward by the lead cam 2309, and the bin 2302 storing the bundle of the second copy is connected to the convey path 2104. At the same time, a front sheet is fed from the front sheet cassette 2401. Thereafter, after the arrival of the front sheet in the book binder 2503 is detected by the front sheet set sensor 2502 like in book binding of the first copy described above, the stapled bundle of transfer sheets as the second copy are conveyed from the pin 2302 to the book binder 2503, and are bound.

The detailed structure of the book binder 2503 according to the present invention will be described in detail below.

Figure 3A:
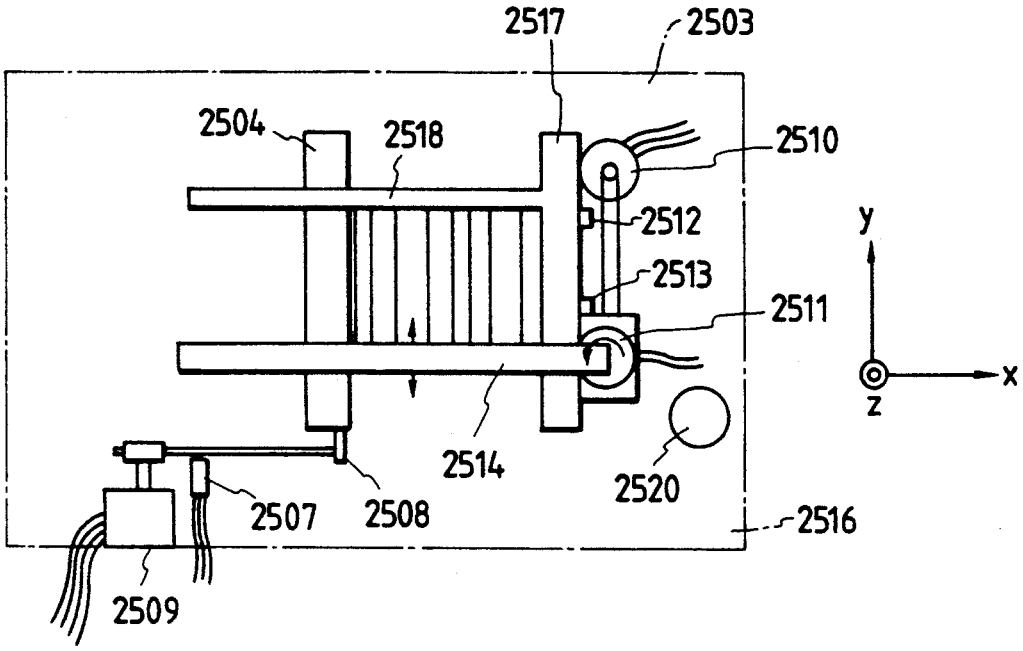
FIGS. 3A and 3B are respectively a plan view and a side view showing a structure of a book binder 2503 according to the embodiment of the present invention.
Figure 3B:
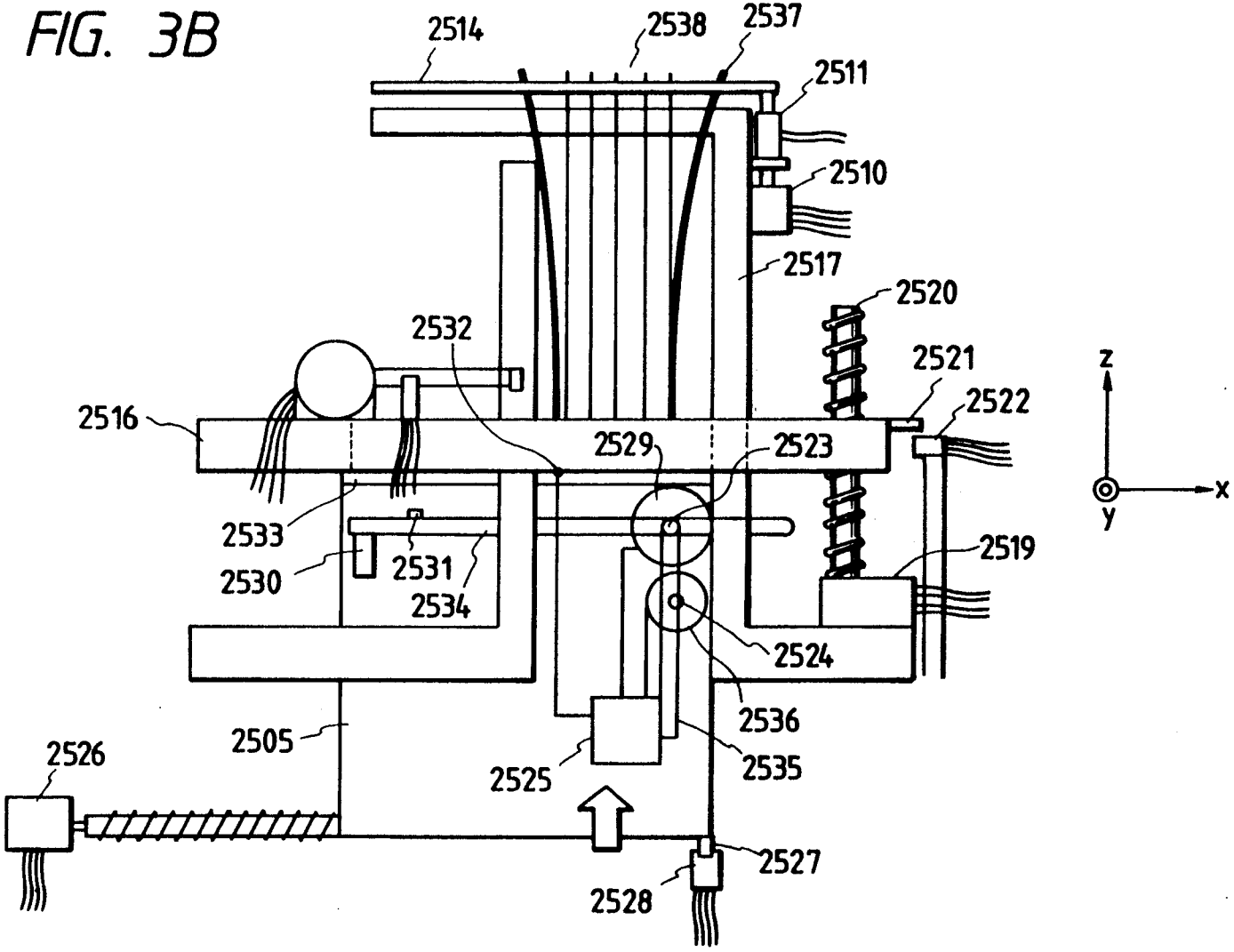

FIG. 3A is a plan view of the book binder 2503, and FIG. 3B shows a side structure of the book binder 2503.

In FIGS. 3A and 3B, a z direction serves as a convey direction. In FIG. 3A, a lateral registration abutment plate 2517 and the lateral regist or registration plate 2504 for binding transfer sheets and a front sheet placed on a base 2516 are arranged to oppose each other.

The lateral registration plate 2504 is movable in an x direction in FIG. 3A, and its position is detected by a lateral registration home sensor 2507 and a lateral registration home flag (position detection plate) 2508. A fore-edge abutment plate 2518 and a fore-edge swing rod 2514 are arranged to be perpendicular to the lateral registration abutment plate 2517. The fore-edge swing rod 2514 is movable in a direction of an arrow in FIG. 3A by a swing rod driving motor 2511. The swing rod driving motor 2511 is connected to a swing unit driving motor 2510. The swing rod driving motor 2511 and the fore-edge swing rod 2514 are moved by the swing unit driving motor 2510 in the fore-edge direction (z direction). The swing position of the swing unit is detected by a fore-edge swing rod home sensor 2512 and a fore-edge swing home flag 2513.

In FIG. 3B, the base 2516 is moved in the z direction by driving a screw shaft 2510 by a base driving motor 2519. The position of the base 2516 is detected by a base home flag 2521 and a base home sensor 2522.

The heating unit 2505 is arranged under the base 2516. The heating unit 2505 comprises a first heat roller 2529, a second heat roller 2536, and its driving system. A heater 2523 is mounted in the first heat roller 2529, and a heater 2524 is mounted in the second heat roller 2536. The first and second heat rollers 2529 and 2536 have different lengths. The heaters 2523 and 2524 also have different lengths and consumption powers. Thus, the heat roller and the heater are selected in accordance with the size and thickness of transfer sheets to be bound.

The first heat roller 2529 is moved along a heat roller horizontal rail 2534, and the second heat roller 2536 is moved along the heat roller horizontal rail 2534 and a heat roller vertical rail 2535 by a driving motor 2530. The positions of the heat rollers 2529 and 2536 are detected by a heat roller sensor 2531. When the second heat roller 2536 is moved along the heat roller horizontal rail 2534, the first heat roller 2529 escapes to a position between the lateral registration abutment plate 2517 and the screw shaft 2520.

A member arranged on the base 2516, e.g., a copper plate 2533 having a high heat conductivity is brought into contact with the first or second heat roller 2529 or 2536, and transmits heat generated by the heater to a front sheet. The spine of the front sheet is heated by this copper plate 2533 to melt a glue applied on the front sheet, thus wetting transfer sheets 2538 and a front sheet 2537 with the glue. A temperature sensor 2532 is arranged near the copper plate 2533. A heater control circuit 2525 performs a temperature adjusting operation of the selected heater 2523 or 2524 on the basis of the detection result of this sensor 2532.

The above-mentioned heating unit 2505 is moved by a heating unit moving motor 2526. A heating unit home flag 2527 and a home sensor 2528 for detecting the position of the heating unit are arranged near the heating unit 2505.

A book bind operation of the book binder 2503 with the above structure will be described below.

When five A4-size transfer sheets are to be bound with a front sheet, the bundle of transfer sheets and the front sheet are conveyed to the book binder 2503, as described above. Prior to conveyance, an x-interval between the lateral registration plate 2504 and the lateral registration abutment plate 2517 is determined by a control circuit (FIG. 6; to be described later) on the basis of information about the thickness of the front sheet and the thickness of the transfer sheet received from the copying machine main body. In this embodiment, if the thickness of the transfer sheet is 100 $\mu$ and the thickness of the front sheet is 500 $\mu$, the interval is determined by adding a constant $\alpha$ to $100\ \mu\times5+500\ \mu\times2=1500\ \mu$. The constant $\alpha$ is a numerical value determined in consideration of conveyance characteristics of a transfer sheet and a distribution of a glue melted by heating, and is set to be 300 $\mu$ in this embodiment.

An interval between the base 2516 and the fore-edge swing rod 2514 (i.e., z-height) is determined as follows. That is, the height is determined by subtracting a constant $\beta$ from 210 mm as an A4-size width. The constant $\beta$ is a correction value for setting a height large enough for the fore-edge swing rod 2514 to satisfactorily register the edges of the transfer sheets. In this embodiment, $\beta=30$ mm. Therefore, the height of the base 2516 is set to be 180 mm. Furthermore, the y-position of the fore-edge swing rod 2514 is set to be 300 mm as a sum of an adjusting margin of 2 mm and a fore-edge length of 298 mm of an A4-size transfer sheet. In this manner, after x-, y-, and z-intervals of the respective units are respectively set to be 1800 $\mu$, 180 mm, and 300 mm, a copy of a bundle of five A4-size transfer sheets and a front sheet are received by the book binder 2503.

In this embodiment, the first heat roller 2523 is selected as a heat roller corresponding to the size of transfer sheet. The first heat roller 2523 is moved along the horizontal rail 2534 to keep the temperature of the copper plate at 150° C. Note that the heat roller is moved by a distance larger than the lateral registration interval by 3.5 mm, thereby heating a spine up to its edge portion. The moving width of the heat roller is changed according to the thickness of a bundle of transfer sheet, as a matter of course. When the trailing end of the conveyed bundle is detected by a book binder sheet supply sensor 2501, heating is executed for a width of (1500+300) $\mu$ for 15 seconds. Thereafter, the lateral registration width is set to be (1500−100) $\mu$, thus enhancing the adhesion properties between the front sheet and the bundle of transfer sheets.

When the heating treatment is completed in this manner, the heating unit 2505 is moved to an escape position, and the bound bundle is conveyed to the fifth convey path 2602 (FIG. 2). The bundle is temporarily stopped at the cooling path 2604. At this time, when the bound bundle is detected by a post-binding trailing end sensor 2601, the heating unit 2505 is returned from the escape position to the home position. Thereafter, the heating treatment of the second copy of a bound bundle is repeated. The bound bundle on the cooling path 2604 is cooled below 40° C. by the book bind cooling fan 2603, as described above, and is then discharged onto the book bind tray 2701.

Figure 6:
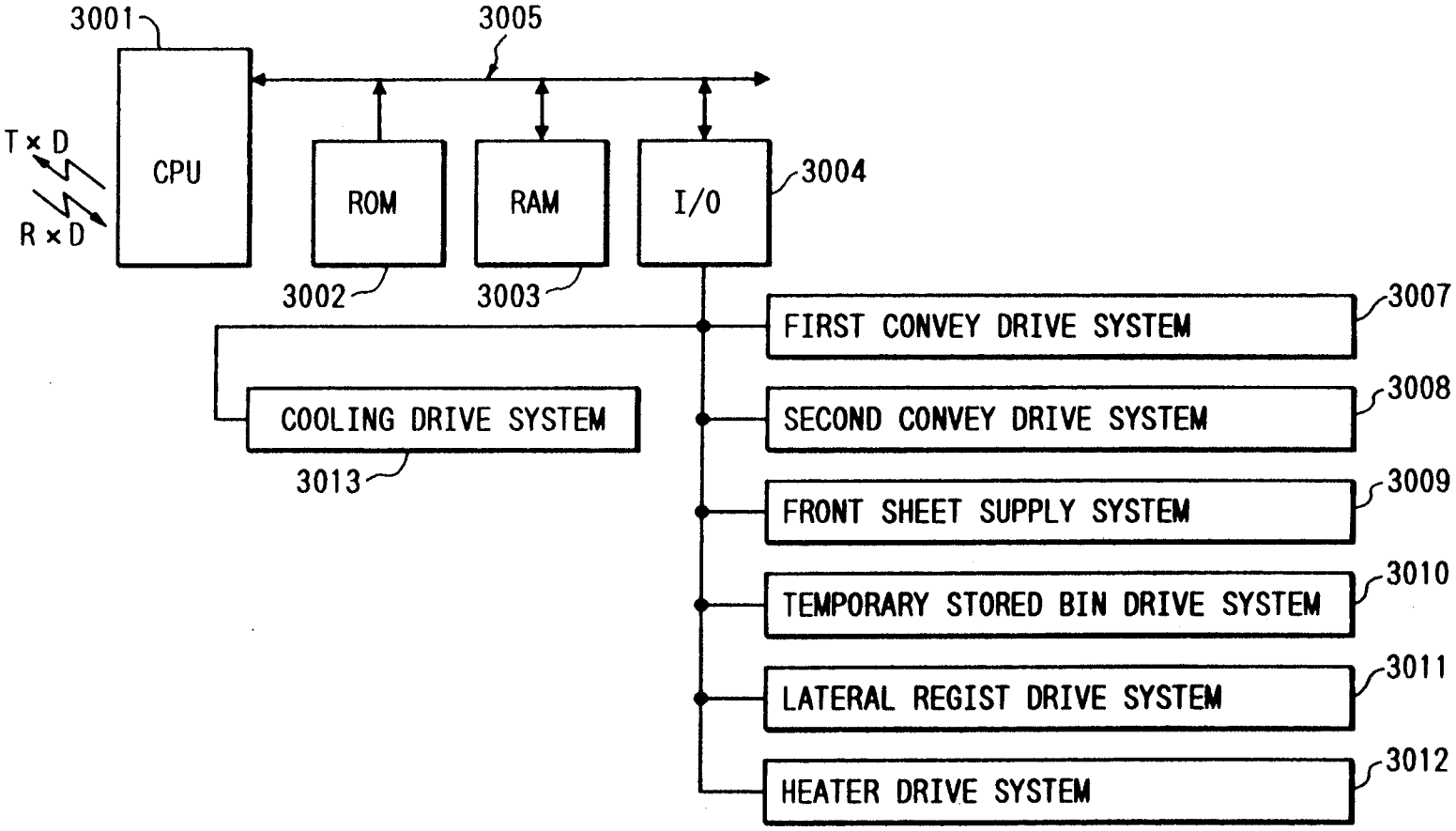
FIG. 6 is a block diagram showing a circuit arrangement of a control system according to the embodiment of the present invention.

FIG. 6 shows a circuit arrangement of a control system for controlling the respective units of the book bind device 2000 shown in FIG. 2. In FIG. 6, a central processing unit (CPU) 3001 controls the overall device by executing a control sequence (to be described later). A read-only memory (ROM) 3002 prestores a control sequence to be executed by the CPU 3001.

A random-access memory (RAM) 3003 stores various data such as arithmetic data of the CPU 3001, control data received from the copying machine 1000, and the like. An input/output interface (I/O) 3004 transfers control signals and operation signals to be exchanged between the CPU 3001 and the constituting units of the book bind device.

The ROM 3002, the RAM 3003, and the I/O 3004 are commonly connected to an address bus 3005, and information transfer control is performed upon an instruction from the CPU 3001.

The I/O 3004 is connected to a first convey drive system 3007, a second convey drive system 3008, a front sheet supply system 3009, a temporary store bin drive system 3010, a lateral regist drive system 3011, a heater drive system 3012, and a cooling drive system 3013.

The first convey drive system 3007 comprises the motor, flapper, and the like associated with conveyance of a transfer sheet in the first convey unit 2100 shown in FIG. 1, and its drive circuit.

The second convey drive system 3008 comprises the motor, flapper, and the like associated with conveyance of a transfer sheet in the second convey unit 2200 shown in FIG. 1, and its drive circuit. The front sheet supply system 3009 comprises a motor for driving a mechanism for selecting a front sheet from the front sheet cassette 2400 shown in FIG. 1, and its drive circuit.

The temporary store bin drive system 3010 comprises a motor shifting the temporary store bin 2300 shown in FIG. 1, and its drive circuit. The lateral regist drive system 3011 comprises a motor for moving the lateral regist plate 2504 in the book binder 2503 shown in FIG. 2, and its drive circuit.

The heater drive system 3012 comprises the heater in the heating unit 2505 in the book binder 2503 shown in FIG. 2, and a circuit for heating this heater. The cooling drive system 3013 comprises the cooling fan 2603 shown in FIG. 2, and its drive circuit. The CPU 3001 exchanges information with the CPU of the copying machine 1000 by serial communications.

Some pieces of information such as size information, copy sheet number information, and manual insertion information of a transfer sheet, post-treatment start information, and the like are input at an operation portion (to be described later) and are transmitted from the copying machine 1000.

Information indicating that the book bind device is in a standby state (during a standby operation), information indicating that the book bind device i busy (under execution of a book bind operation), size information of a front sheet set in the front sheet cassette, information indicating the presence/absence of a front sheet in the cassette, information indicating a thickness of a front sheet, and abnormality information indicating a sheet or front sheet jam in the book bind device are transmitted from the CPU 3001 of the book bind device to the CPU 1101 of the copying machine main body.

Various keys, arranged on the operation portion of the copying machine main body 1000, for issuing operation commands to the copying machine main body 1000 and the book bind device 2000 and their command contents will be described below with reference to FIGS. 7A to 7D.

Figure 7A:
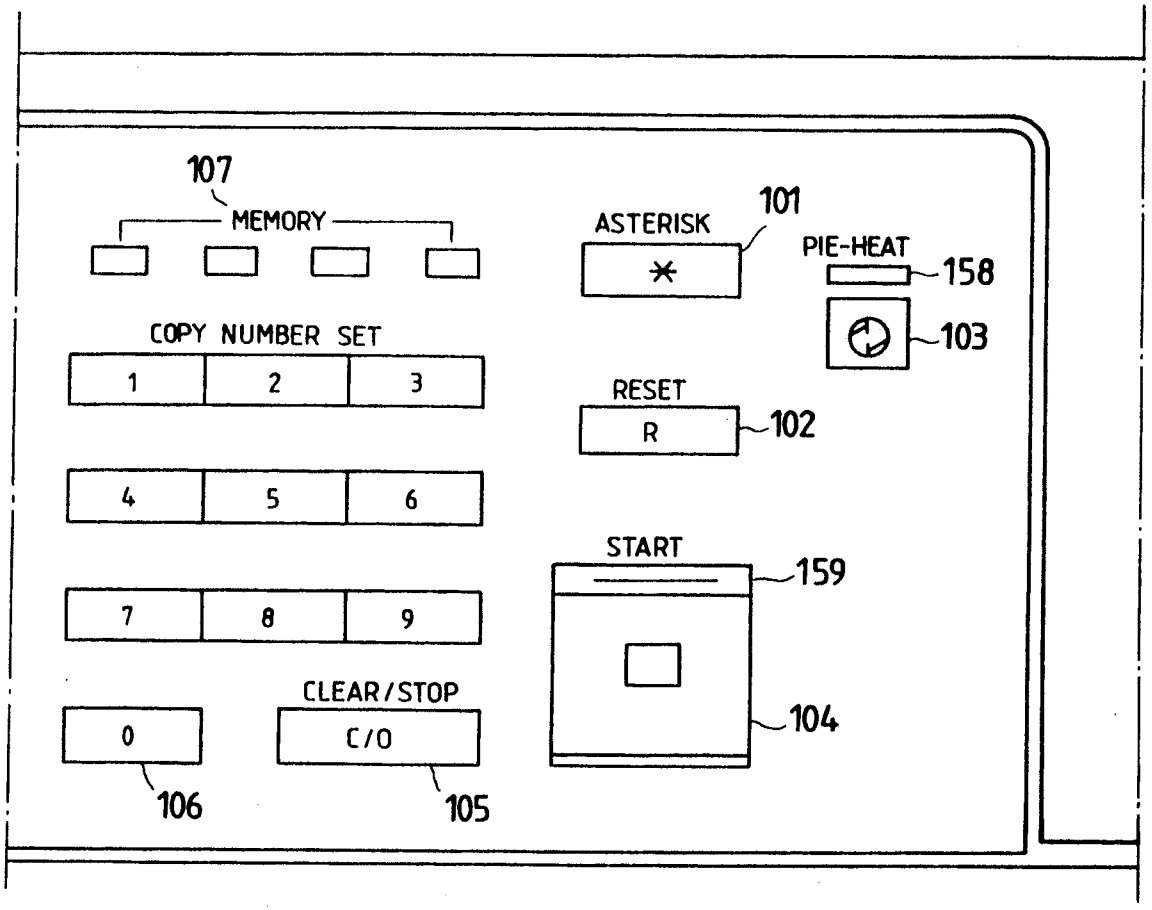
FIGS. 7A to 7D are front views showing key arrangements on an operation panel of a copying machine according to the embodiment of the present invention.

In FIG. 7A, an * (asterisk) key 101 is used by an operator in setting modes for setting, e.g., a bind margin amount, an original frame erase size, and the like.

An all-reset key 102 is depressed when an operation mode is reset to a standard mode. A pre-heat key 103 is depressed to set the overall device in a pre-heat state or to cancel the pre-heat state. The pre-heat key 103 is also depressed when the device is resumed from an auto shut-off state to the standard mode.

A copy start key 104 is depressed to start a copy operation. A clear/stop key 105 is used as a clear key in a standby state, and is also used as a stop key during a copy operation. The clear key is depressed to cancel the set copy sheet number. The clear key is also used to cancel the * (asterisk) mode. The stop key is depressed to interrupt a continuous copy operation. In this case, the copy operation is stopped after a copy operation at the time of depression is completed.

A ten-key pad 106 is used to set a copy sheet number. The ten-key pad 106 is also used to set the * (asterisk) mode. The ten-key pad 106 is also used when the sheet number is set in a manual insertion book bind mode. Memory keys 107 are used by an operator to register modes to be frequently used.

Figure 7B:
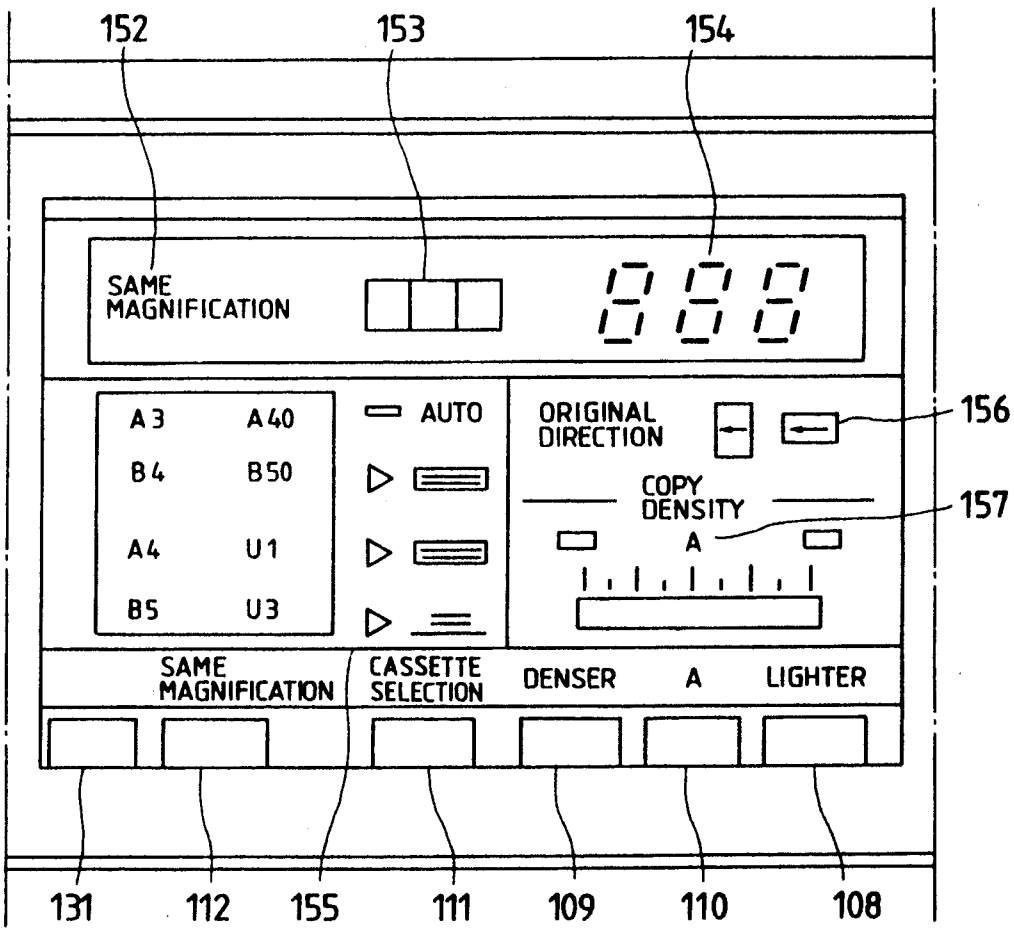

In FIG. 7B, copy density keys 108 and 109 are depressed to manually adjust a copy density. An AE key 110 is depressed when a copy density is automatically adjusted according to the density of an original or when an AE (automatic density control) mode is canceled to a manual mode.

A cassette select key 111 is depressed when an upper cassette 18, a lower cassette 19, or a lower paper deck 20 is selected. When an original is set on an automatic original feeder 35, an APS (automatic paper selector) can be selected. A same magnification key 112 is depressed when a copy operation is performed at the same magnification (original size).

Figure 7C:
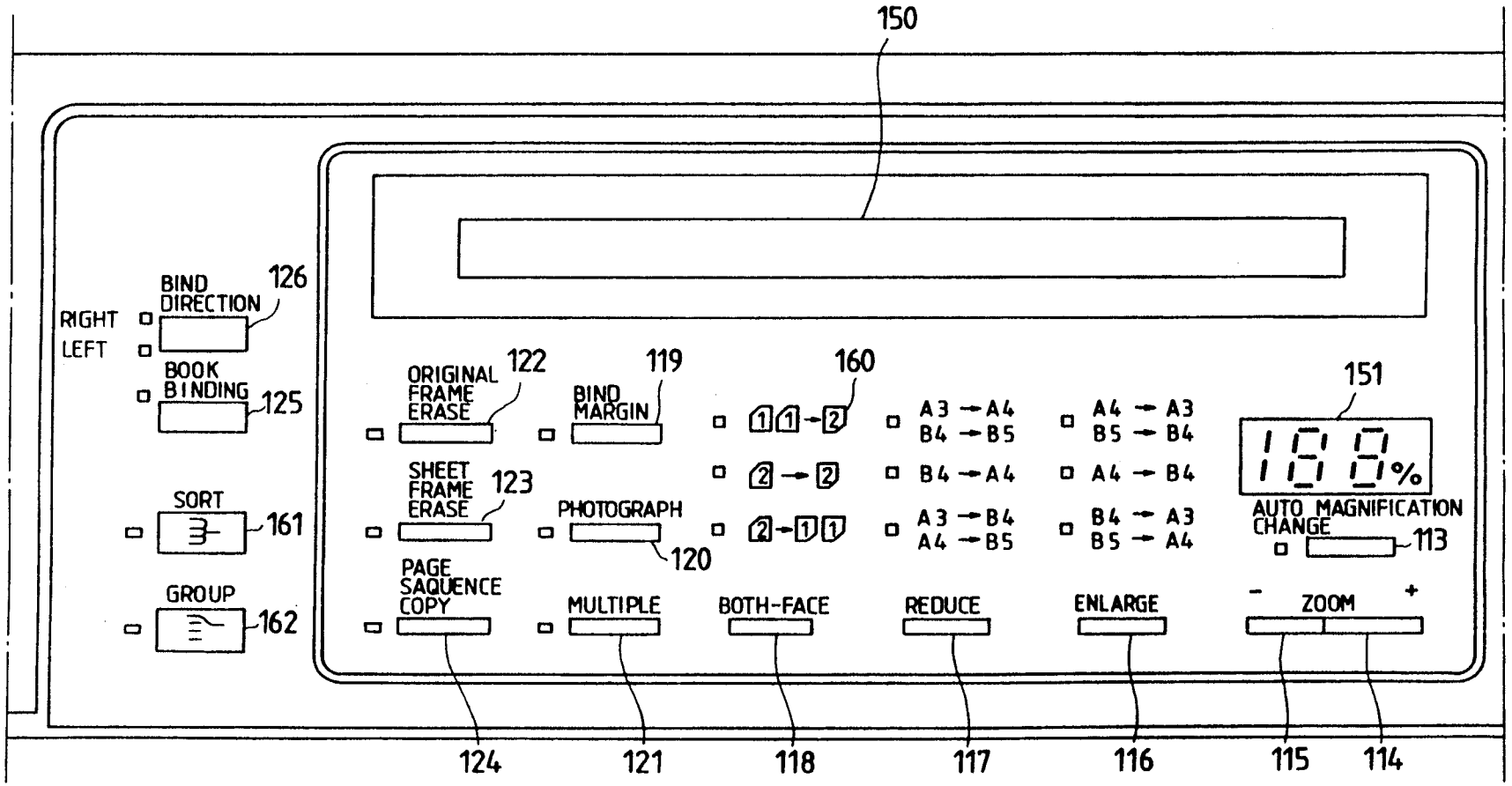

In FIG. 7C, an auto magnification change key 113 is depressed to automatically reduce or magnify the size of an original in correspondence with the designated copy sheet size. Zoom keys 114 and 115 are depressed to set an arbitrary magnification between 64% and 142%. Fixed magnification keys 116 and 117 are depressed to reduce or magnify the size at a fixed magnification.

A both-face key 118 is depressed to perform a both-face copy operation of a single-face original, or a both-face copy operation of a both-face original, or a single-face copy operation of a both-face original. A bind margin key 119 is depressed to form a bind margin having a designated length on the left side of a transfer sheet.

A photograph key 120 is depressed to copy a photograph original. A multiple key 121 is depressed to form an image on the same face of a transfer sheet based on two original sheets. An original frame erase key 122 is depressed by an operator to perform a fixed size original frame erase operation, and the size is set by the * key. A sheet frame erase key 123 is depressed to erase a frame in correspondence with a cassette size.

A page sequence copy key 124 is depressed to copy right and left pages of an original on different sheets. Both-face copy indicators 160 are turned on when one of a both-face copy mode from a both-face original, and a both-face copy mode from a single-face original is selected.

A book bind key 125 is depressed to operate the device in the book bind mode. A bind direction select key 126 is depressed to select a right or left bind mode. A sort key 161 is turned on in the standard mode when a sorter is added. The sort key 161 is depressed to cancel or set a sort mode.

A group key 162 is depressed to form a plurality of copies of one original, and to store them in units of temporary store bins of the book bind device. An LCD (liquid crystal display) message display 150 is a semi-transmission type liquid crystal display which defines one character by 5×7 dots, and corresponds to 40 characters, and uses two colors as backlight. The message display 150 is normally illuminated by a green backlight, and is illuminated by a orange backlight in an abnormal state or a copy disable state. When a front sheet selection key 127 is depressed, the message display 150 displays a thickness of a front sheet stored in the designated front sheet cassette. A magnification display 151 displays a set magnification in units of %.

Referring back to FIG. 7B, a same magnification indicator 152 is turned on when the same magnification is selected. Color developing unit indicators are denoted by numeral 153. A copy sheet number display 154 displays a copy sheet number or a self-diagnosis code.

Use cassette indicators 155 indicate a selected one of upper, intermediate, and lower cassettes, and a deck. An original direction indicator 156 indicates a set direction of an original (longitudinal or lateral set). An AE indicator 157 is turned on when the AE (automatic density control) mode is selected.

Referring back to FIG. 7A, a pre-heat indicator 158 is turned on when the pre-heat state is set, and flickers in the auto shut-off state. A ready/wait indicator 159 has green and orange LEDs, and is turned on in green in a ready state (copy enable state) or in orange in a wait state (copy disable state).

Figure 7D:
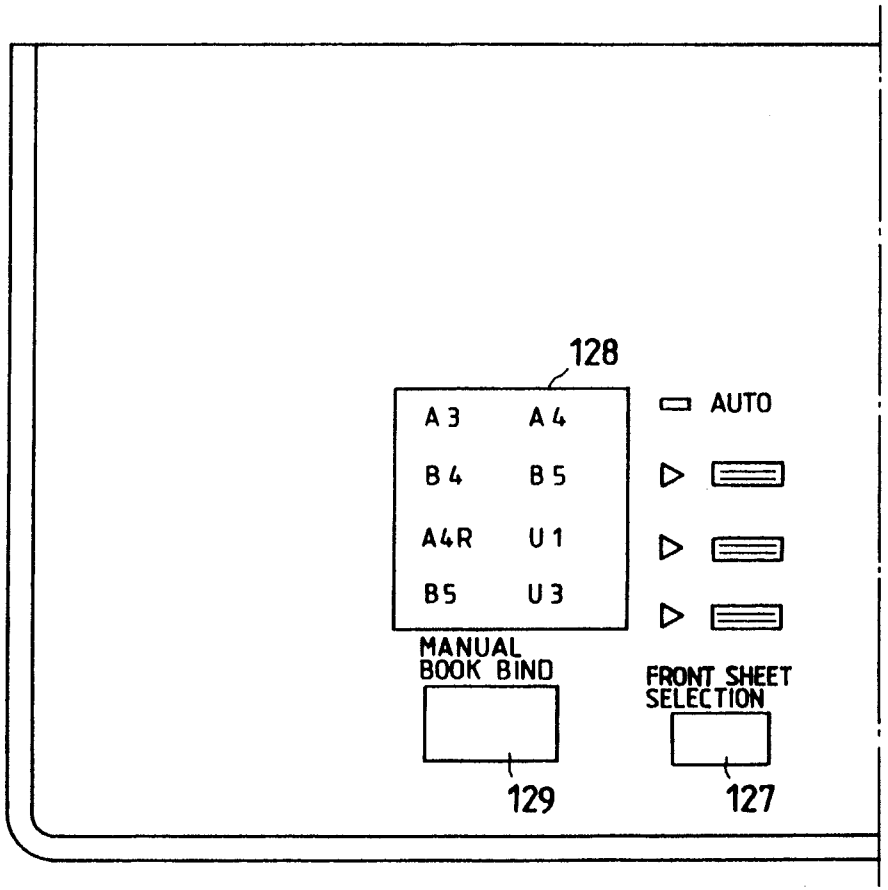

In FIG. 7D, the front sheet selection key 127 is depressed to select one of the upper front sheet cassette 2401, the intermediate front sheet cassette 2402, and the lower front sheet cassette 2403. When the book bind key 125 is depressed, an auto mode of a front sheet cassette indicator 128 is normally selected. However, the auto mode is not selected when transfer sheets are placed on the temporary store bins later or in the manual book bind mode. A manual book bind key 129 is depressed to manually bind a book.

The processing operations of the copying machine main body and the book bind device associated with the book bind treatment will be described below with reference to the flow charts shown in FIGS. 8A and 8B, and FIGS. 9A to 9F. In this embodiment, two copies of five A4-size original sheets (pages) are bound.

Figures 1, 8A:
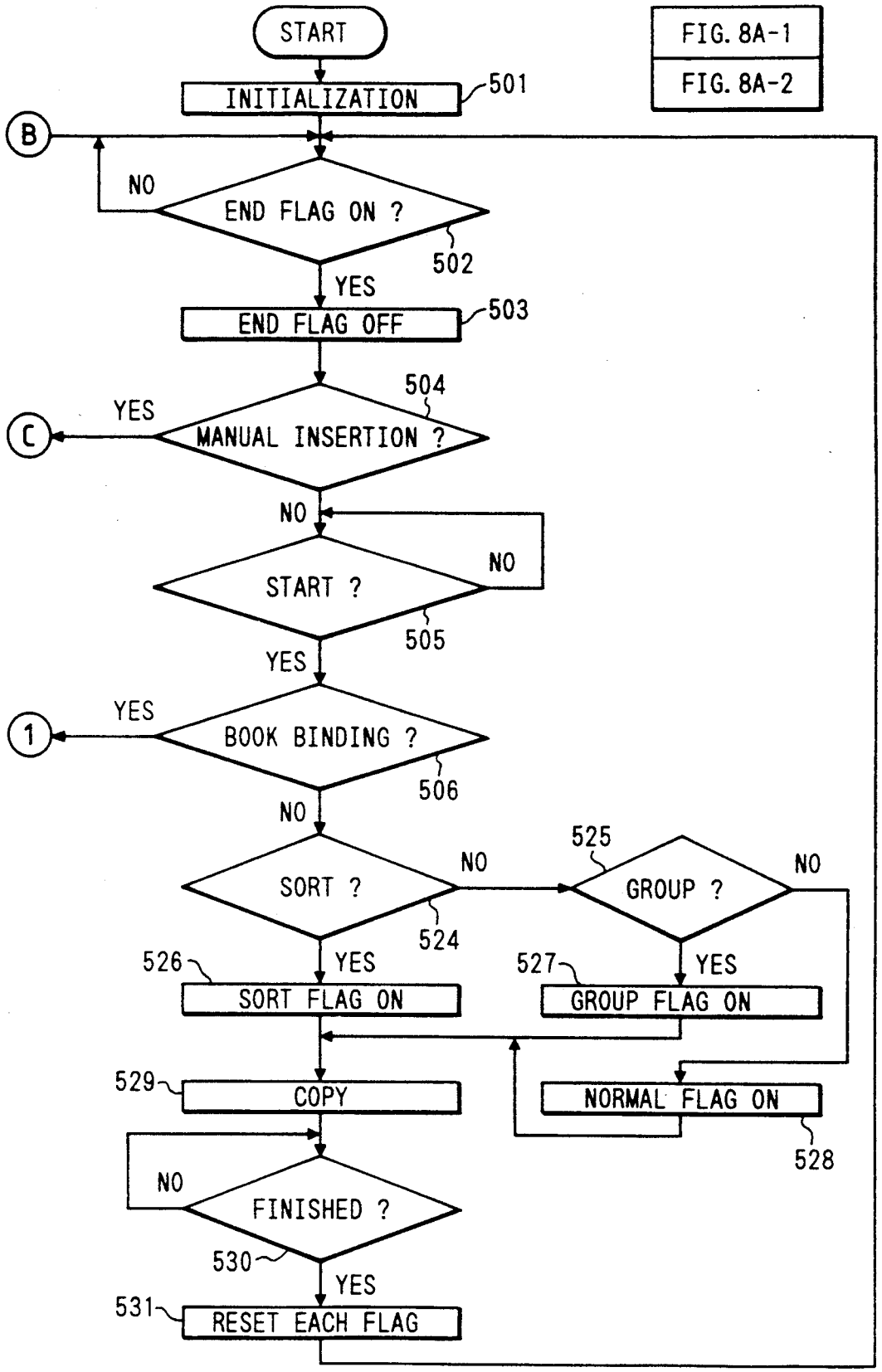
FIG. 8A and 8B are flow charts showing treatment operations executed in the copying machines.
Figures 2, 8A:
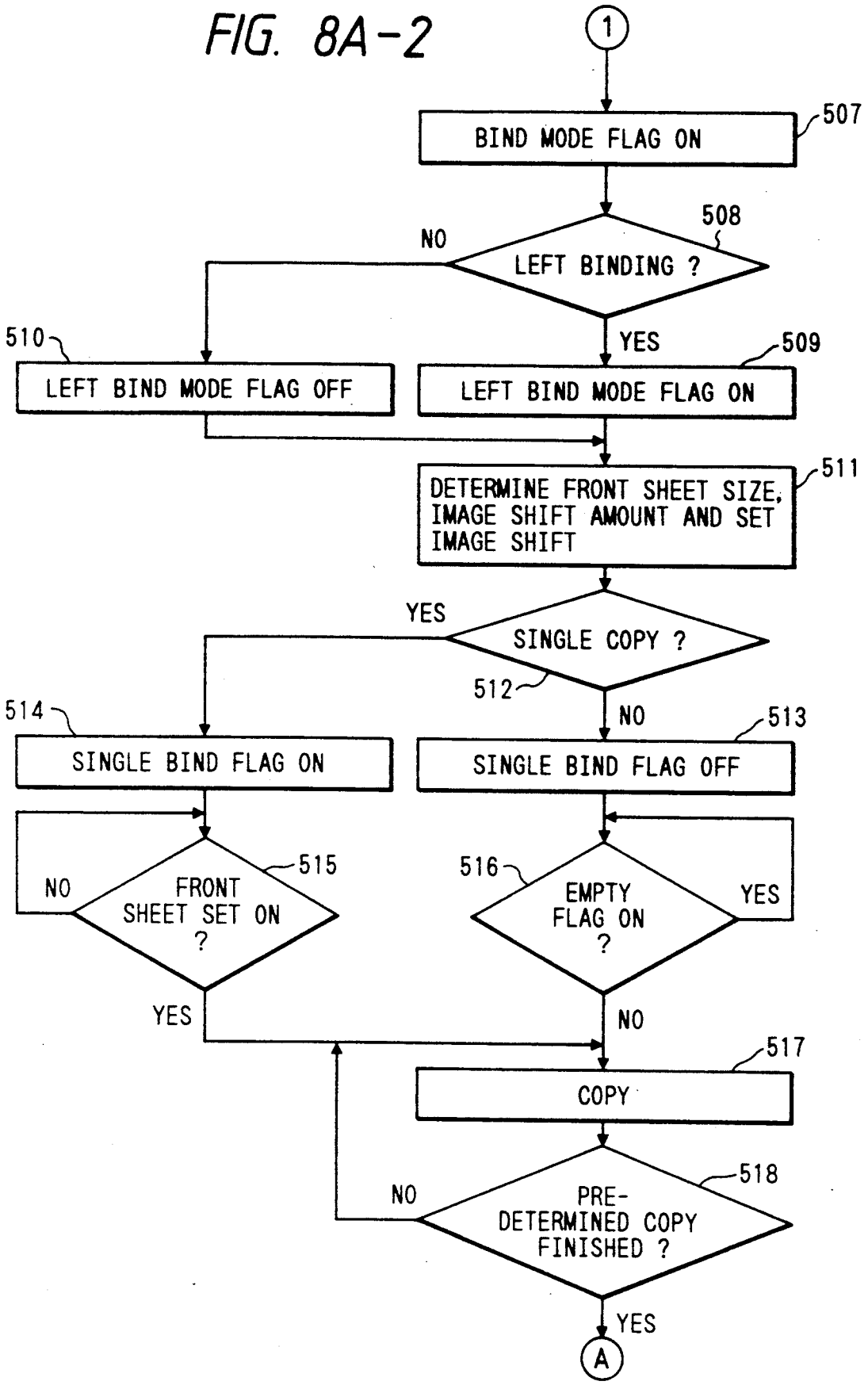
Figure 8B:
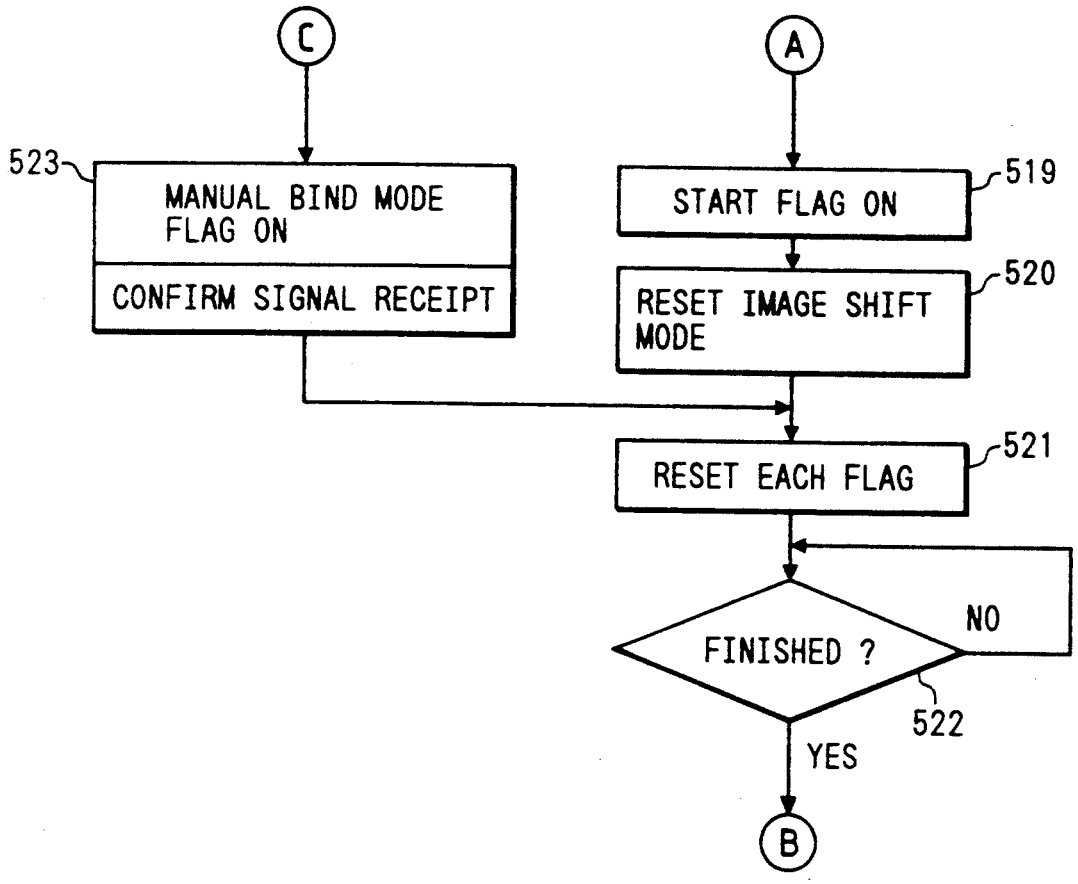

FIGS. 8A and 8B show control treatment operations executed by the CPU of the copying machine main body, and FIGS. 9A to 9F show control treatment operations executed by the CPU of the book bind device (i-A) Multiple Copy Book Bind As an initialization treatment (step 501 in FIG. 8A), it is confirmed that a voltage and a temperature of the copying machine main body reach predetermined values. Whether or not the original treatment device and the book bind device connected to the copying machine have completed operations and are ready to start a copy operation is then confirmed by checking if an end flag is ON (step 502 in FIG. 8A). The end flag is flag information indicating a copy operation state. When this flag is ON, it indicates an operation state; when it is OFF, it indicates an operation end state. An ON/OFF state of the end flag is determined on the basis of operation information sent from the original treatment device and the book bind device to the copying machine main body.

In step 504, the level of a key input signal from the operation portion is checked to determine whether or not a book bind mode with an opened manual insertion tray is instructed. In this case, since the manual insertion book bind mode is not set, the flow advances to step 505 to wait for depression of the start key 104 When the book bind key 125 and the start key 104 are depressed by an operator, the book bind mode is selected, and the flow advances from step 506 to step 507. A bind mode flag indicating that the book bind mode is set is turned on, and this flag information is also sent to the book bind device.

Whether the right or left binding is designated in the book bind mode is determined on the basis of a command input from the bind direction select key 126 of the operation portion. If no designation input is made, the left bind mode is automatically set. In this case, the left bind mode is designated, and as a result, a left bind mode flag is turned on. This flag information is sent to the book bind device (steps 508 and 509 in FIG. 8A). If the right bind mode is designated, the left bind mode flag is turned off (steps 508 and 510).

Then, original size information and sheet number information are received from the original treatment device, and a front sheet suitable for the size and sheet number of original is selected from front sheet data. The selected data is written in communication data. For example, in this embodiment, front sheets for one to five A4-size sheets per copy are selected for two copies of five A4-size original sheets.

A gluing margin according to the number of original sheets is calculated in step 511. In this embodiment, the gluing margin is set to be 10 mm when the number of original sheets is one to five; it is set to be 12 mm when the number of original sheets is five to ten; and it is set to be 14 mm when the number of original sheets is eleven to twenty. In order to define a gluing margin region corresponding to the set gluing margin on a transfer sheet, an original image shift record mode is set. An original image shift amount is variably set in accordance with the number of original sheets in the same manner as in the gluing margin.

Subsequently, after it is confirmed in step 516 based on empty flag information in information transmitted from the book bind device that there are no transfer sheets on the temporary store bins in the book bind device, the set number of copies of original sheets are divisionally copied in the image shift mode.

If it is detected that there are transfer sheets on the temporary store bins, an alarm display is made by the LCD 150 to instruct an operator to remove the transfer sheets.

When the copy operation of the original is completed in a known copy treatment sequence, a start flag for instructing the book bind device to start a book bind operation is turned on, and the flag information is written in data to be transmitted to the book bind device (step 519 in FIG. 8B). After the above-mentioned transmission data is transmitted to the book bind device, the image shift mode is canceled, and the flags used in the copying machine are reset in a software manner (steps 520 and 521).

A control treatment on the side of the copying machine is completed as described above, and after the operation of the book bind device is completed (step 521), the flow returns to step 502 in FIG. 8A to set a copy command wait state for the next original.

(ii-A) Single Copy Book Bind

The same operations as in the above-mentioned multiple copy book bind treatment are performed except that, in FIG. 8A, after a single copy book bind mode is confirmed, it is detected that a front sheet is set in the book binder, and a copy operation is started (steps 512, 514, and 515).

(iii-A) Book Bind Operation Using Manual Insertion Tray

When a book bind mode using the manual insertion tray is instructed from the operation portion, this is detected by a judgement treatment in step 504 in FIG. 8A, and the flow advances to step 523 in FIG. 8B. In step 523, a manual bind mode flag in communication data is turned on. The number of sheets to be manually inserted input at the ten-key pad 106 of the operation portion and front sheet data selected and input by the front sheet selection key 127 are transmitted from the copying machine main body to the book bind device together with the manual bind mode flag information. After it is confirmed that this transmission information is received, the flags are reset to initial states, thus waiting for completion of the operation of the book bind device (steps 523, 521, and 522).

(iv-A) Operation Mode Other Than Book Bind Mode

The book bind device can serve as a sorter since it has a plurality of bins. When a sorter mode is selected and input at the operation portion, a communication sort flag is turned on in the order from step 524 to step 525 in FIG. 8A, and a sorter mode command is sent to the book bind device.

When transfer sheets are to be sorted in units of original groups, a group flag is turned on (steps 525 and 527). When a normal sort treatment is to be performed, a normal flag is turned on (step 528), and a type of sort mode is informed to the book bind device by means of the above-mentioned flag information.

After the following operation is performed, initialization is performed, and the control waits for the next copy command (steps 529, 530, 531, and 502).

A control treatment operation executed by the CPU of the book bind device will be described below.

(i-B) Multiple Copy Book Bind

Figures 1, 9A:
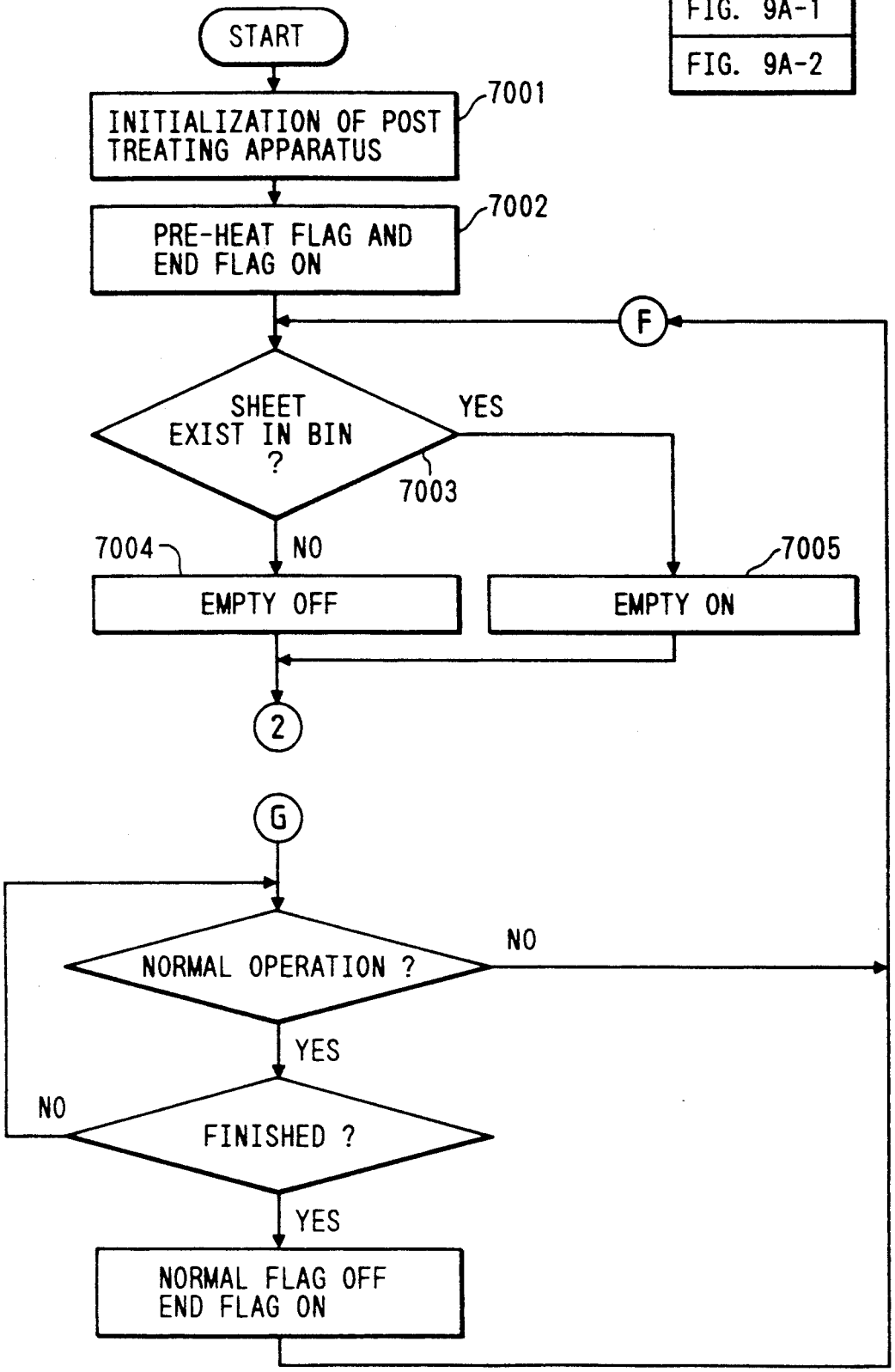
Figures 2, 9A:
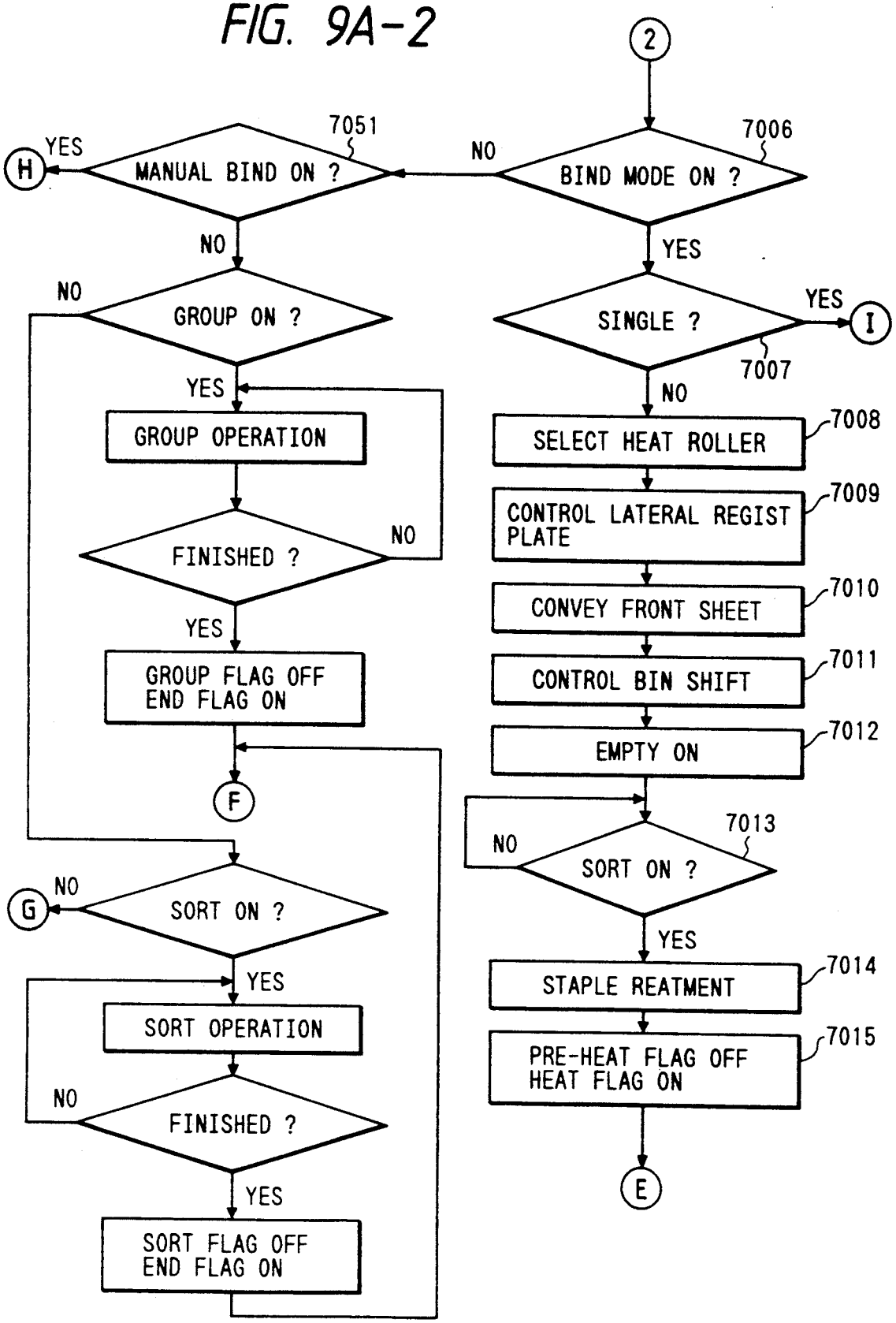

When some pieces of command information indicating A4 size, five sheets, two copies, and left bind mode are sent from the copying machine main body, a control sequence shown in FIG. 9A is executed first.

In FIG. 9A, initialization is performed in step 7001, and a pre-heat flag indicating a pre-heat state is turned on. Then, in order to inform the copying machine main body of completion of initialization in the book bind device, an end flag is turned on (step 7002). It is checked in step 7003 on the basis of a sensor output if there are sheets on the temporary store bins 2301 to 2305. If NO in step 7003, an empty flag is turned on to store a sheet presence/absence state (step 7004).

If YES in step 7003, however, the empty flag is turned on (step 7005).

In this embodiment, since a book bind mode is instructed by the book bind key 125, the flow advances from step 7006 to step 7008 via step 7007. In step 7008, a heater matching with an A4-size front sheet width corresponding to display data "001" (FIG. 10) in reception data is selected. In this case, after it is confirmed that the pre-heat flag is on, the selected heater is preliminarily heated. FIG. 11 shows contents of various display data used in this embodiment.

In FIG. 11, bit positions 0 to 2 represent a size of a front sheet, and bit positions 3 to 5 represent a proper thickness of a front sheet. Bit positions 6 to 7 represent a color of a front sheet, and a bit position 8 represents the presence/absence of a front sheet When a front sheet cassette is loaded in the main body, a corresponding microswitch on the main body is turned on by a three-dimensional pattern formed on the front sheet cassette, and generates the above-mentioned code signal representing a type of front sheet inserted in the front sheet cassette.

Referring back to FIG. 9A, in step 7009, the thickness (300 $\mu$) is added to thickness data (500 $\mu$) sent from the copying machine main body, and the lateral registration plate 2504 is displaced in the direction of thickness (x direction) by the calculation result of 800 $\mu$.

A y-lateral registration amount is set to be 300 mm by adding an adjusting margin of 2 mm to the A4-size front sheet length of 298 mm indicated by the reception data. As for a z-lateral registration amount, 180 mm is set by subtracting an adjusting margin of 30 mm from the A4-size sheet width of 210 mm determined by the reception data.

In step 7010, the upper front sheet cassette 2401 is selected on the basis of the reception data indicating the A4-size front sheet and the sheet number of original of 5. The A4-size front sheet is conveyed from the selected cassette to the book binder 2503.

In step 7011, the transfer sheets conveyed from the copying machine main body are sorted into two copies while vertically shifting the temporary store bins 2301 and 2302 so as to form two copies. When the transfer sheets are set on the temporary store bins 2301 and 2302, the empty flag is turned on in step 7012. In step 7013, the control waits until permission for a gluing operation (book bind operation) is sent from the copying machine, and reception of the permission is detected when a start flag is turned on.

Upon this detection, the five A4-size transfer sheets set on each of the temporary store bins 2301 and 2302 are stapled (temporarily bound) by the staple device 2310 in step 7014. In step 7015, the pre-heat flag is turned off, and a heat flag is turned on instead for causing the heating unit to execute a normal heating operation. A temperature adjusting operation is performed so that a heating temperature is set at 150° C. The flow then advances to step 7016 in FIG. 9B, and the reception data is checked to detect that a bind direction is set to be a left bind direction.

After the bind direction is detected, in step 7017, the stapled bundle (of five A4-size sheets) is conveyed to the book binder 2503 through the convey paths 2104 and 2105. On the other hand, when the left bind flag is turned off to instruct a right bind mode, the stapled bundle (of five A4-size sheets) travels along the convey paths 2104, 2103, and 2105 by a reverse roller 2108, and is conveyed to the book binder 2503.

In step 7020, a heat ready flag is monitored. The heat ready flag is turned on when the heating unit temperature reaches 150° C., i.e., reaches a temperature required for gluing the front sheet and the transfer sheets.

When the heat ready flag is turned on, a first timer is started in step 7021. Note that the first timer measures 15 sec. In step 7022, whether or not the first timer is time-up (end of measurement) is checked. If it is detected that the first timer is time-up, the x-lateral registration amount of the lateral registration plate 2504 is changed from 1800 $\mu$ to 1400 $\mu$ in step 7023, thus pressurizing the bundle of transfer sheets.

In step 7024, a second timer is started. The second timer measures a pressurizing time of 15 sec. When the second timer is time-up, a cooling flag is monitored in step 7026.

The cooling flag is turned on when the bound bundle is stopped at the cooling path 2604, and is cooled. When the cooling flag is ON and the bundle bound in the immediately preceding process is present in the cooling path 2604, the control stands by in step 7026 until cooling of the bound bundle is completed.

When the cooling flag is turned off, it is determined that cooling is ended, and the flow advances to step 7027 to move the heating unit present under the book binder 2503. The bound bundle presently located in the book binder 2503 is conveyed to the cooling path 2604.

After the bound bundle is stopped in the cooling path, the cooling fan is rotated to cool the bound bundle. Furthermore, after the heating unit presently located at the escape position is returned to a predetermined position, the cooling flag is turned on. In step 7028, the number of copies of bound bundles is checked, and the above-mentioned book bind operation is repetitively executed until a designated number of copies of bundles are formed (steps 7028 to 7016). After the designated number of copies of bundles are formed, the above-mentioned flags are turned off, and the end flag is turned on. The flow then returns to step 7003 in FIG. 9A to wait for the next book bind command.

Figure 9B:
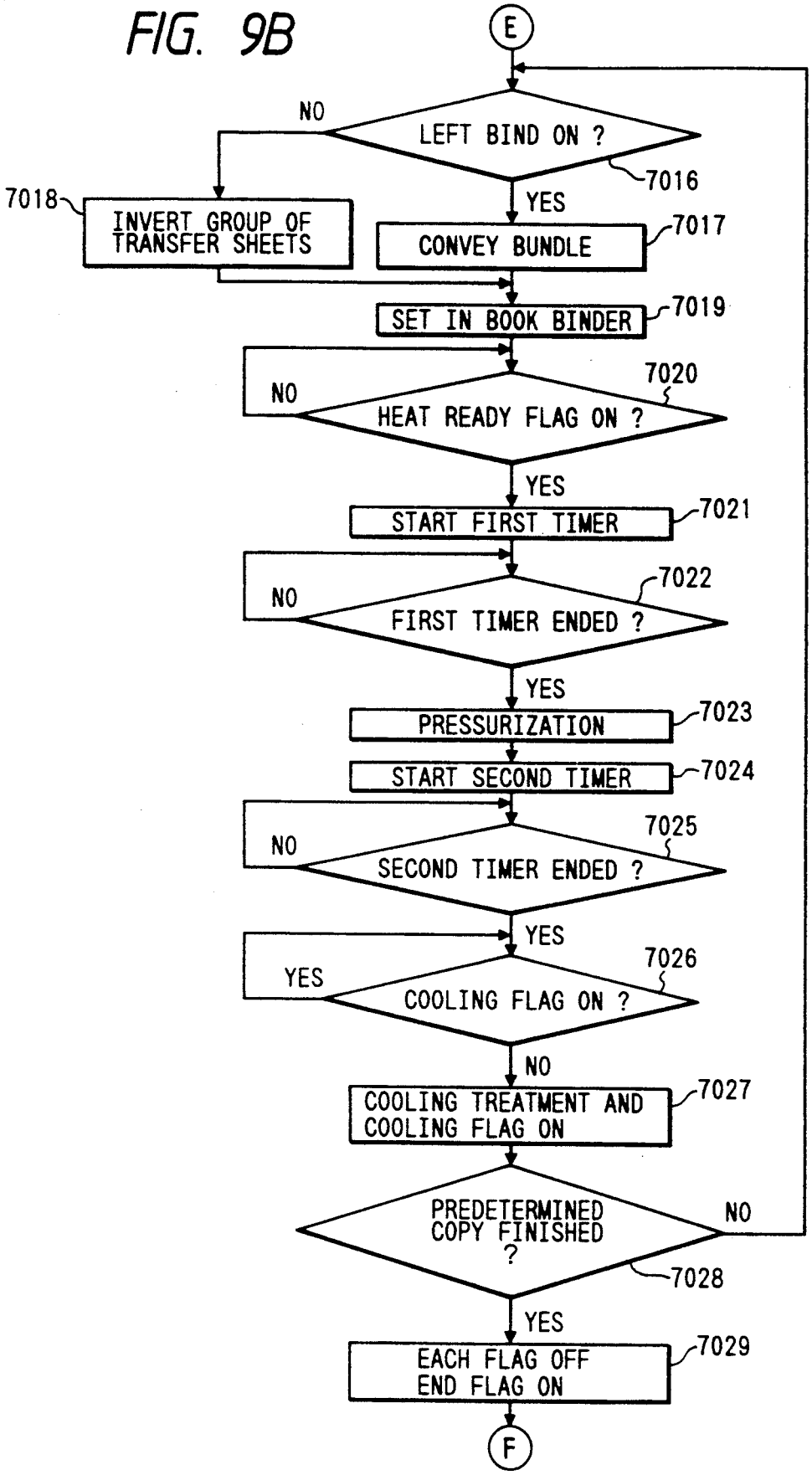
Figure 9C:
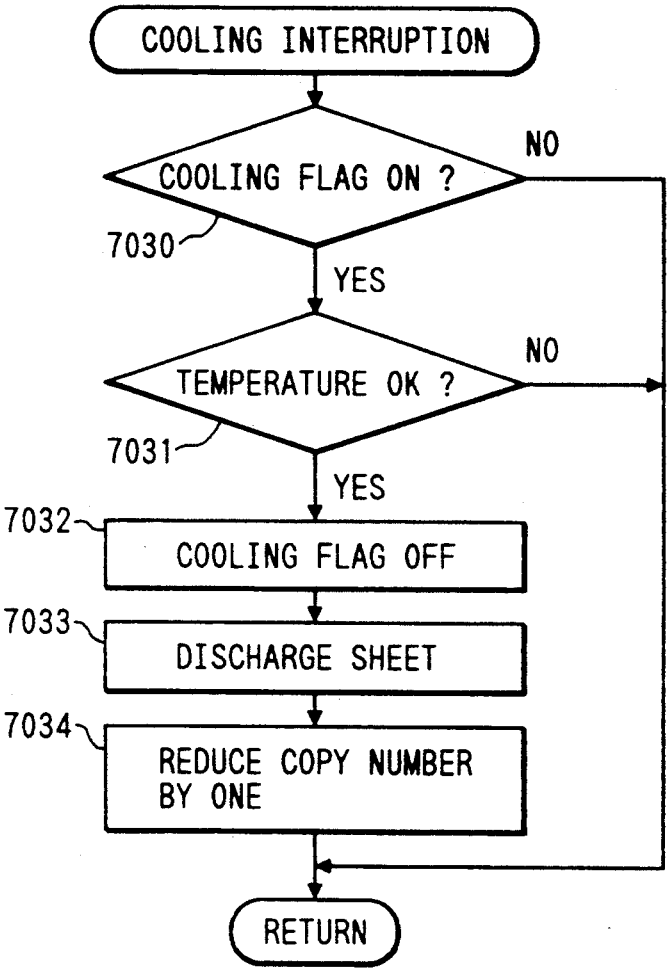

FIG. 9C shows a detailed control sequence of the cooling treatment in step 7027 in FIG. 9B. This control sequence forcibly interrupts the main routine at 10-msec intervals, and is executed.

In FIG. 9C, the value of the cooling flag is checked in step 7030. If NO in step 7030, no cooling treatment is executed, and the flow returns to the main control sequence. If YES in step 7030, however, the output value of the temperature sensor is checked in step 7031 to determine if the temperature of the bound bundle is decreased to 40° C. If NO in step 7031, the cooling fan is kept ON, and this control sequence is ended.

After the above-mentioned sequence is repetitively executed, if it is determined that the temperature of the bound bundle is decreased below 40° C., the cooling flag is turned off in step 7032, thereby stopping the cooling fan. The flow then advances to step 7033, and the bound bundle is conveyed to the cooling path 2604 again, and the cooled bundle is discharged onto the book bind tray 2701. In step 7034, "1" is subtracted from the number of copies to be bound, and this control sequence is ended.

Figure 9D:
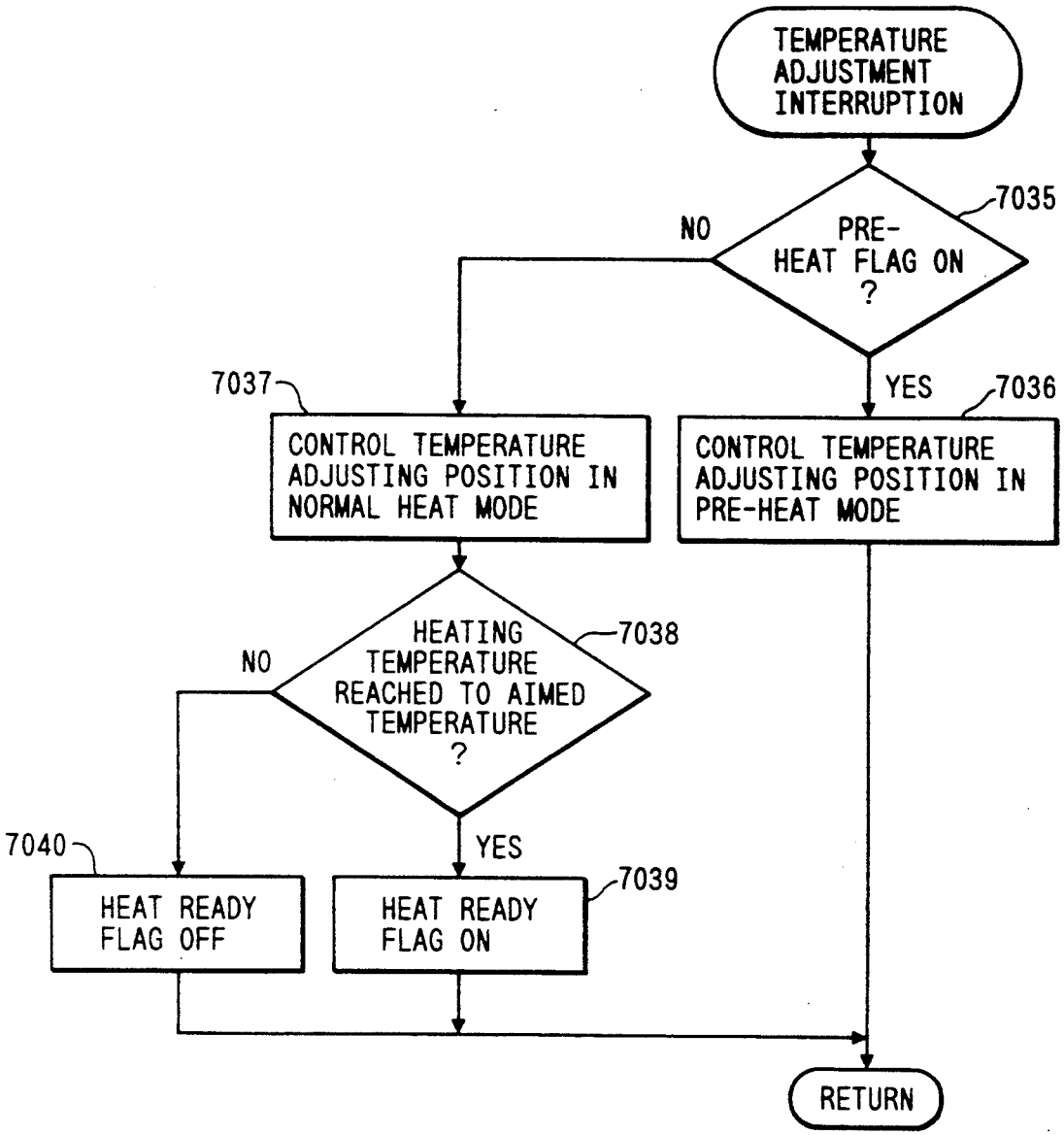

FIG. 9D shows a control sequence for the heating treatment of the bound bundle. This control sequence also forcibly interrupts the main routine at 10-msec intervals, and is executed.

In FIG. 9D, it is checked in step 7035 if the pre-heat flag is ON, i.e., if the pre-heating operation is instructed. If YES in step 7035, the flow advances to step 7036. In step 7036, in order to keep the temperature of the copper plate 2533 for performing heating at a target value 60° C. in the pre-heat mode, the temperature adjusting operation of the heater in the heating unit is performed. Position control of the heater is then made, i.e., the heater is reciprocally and horizontally moved below the copper plate 2533, thus ending this control sequence. When the temperature of the copper plate does not reach 150° C. as a target value yet, the heat ready flag is turned off in step 7040, and this control sequence is ended.

The above-mentioned control sequence is repetitively executed, and if it is detected in step 7038 that the temperature of the copper plate 2533 reaches 150° C. as the target value, the heat ready flag is turned on in step 7039 to store a book bind enable state, thus ending this control sequence.

(ii-B) Single Copy Book Bind

If the number of copies is 1, the flow advances from single copy mode check step 7007 in FIG. 9A to step 7041 in FIG. 9B, and a heater is selected depending on a front sheet and the number of original sheets. In this embodiment, since five A4-size sheets are to be bound, an A4-width heater is selected. Then, control of the lateral registration plate and a front sheet convey treatment are performed in step 7042. In step 7043, a front sheet set flag indicating that the front sheet is set in the book binder 2503 is turned on, and this flag information is sent to the copying machine main body by a communication. It is then checked in step 7044 if the bind direction is set in the left bind mode.

Since the left bind mode is selected in this embodiment, the flow advances to step 7045. Transfer sheets discharged from the copying machine main body pass through the single copy convey path 2103 in the book bind device, are reversed by the reverse roller 2108 in the third convey path 2104, and are then conveyed to the fourth convey path 2105. When the right bind mode is selected, the transfer sheets are conveyed from the single copy convey path 2103 to the fourth convey path 2105. In step 7046, the angle of a sheet supply flapper 2205 is controlled so that the transfer sheets fed to the book binder are sorted in the order of the first sheet, the second sheet, the third sheet, . . . It is then checked in step 7047 if treatments corresponding to the number of original sheets are completed.

When the angle control of the sheet supply flapper 2205 is not completed yet, the flow returns to step 7044 to wait for completion of this control treatment. When the angle control of the sheet supply flapper 2205 is completed, the flow advances step 7048. In step 7048, a heating treatment and a compression treatment are performed in the same manner as in the multiple copy book bind operation, and the transfer sheets are then cooled until a temperature is decreased to 40° C. When cooling is completed in step 7049, the respective flags are reset, and the end flag indicating that the book bind operation is ended is turned on. Thereafter, the flow returns to step 7003 as an initial state.

(iii-B) Manual Insertion Book Bind

A case will be described below wherein a user instructs a manual insertion book bind mode using the manual book bind key. For this purpose, the user sets A4-size transfer sheets on the temporary store bin 2301, selects an A4-size front sheet by the front sheet selection key 127, inputs "5" as the number of transfer sheets using the ten-key pad 106, and then depresses the manual book bind key.

The copying machine main body 1000 transfers the manual insertion book bind command from the operator and book bind information therefor to the book bind device 2000. Upon reception of this command, the CPU 001 of the book bind device 2000 turns on a manual bind mode flag, and turns off a bind mode flag.

Figures 1, 9E:
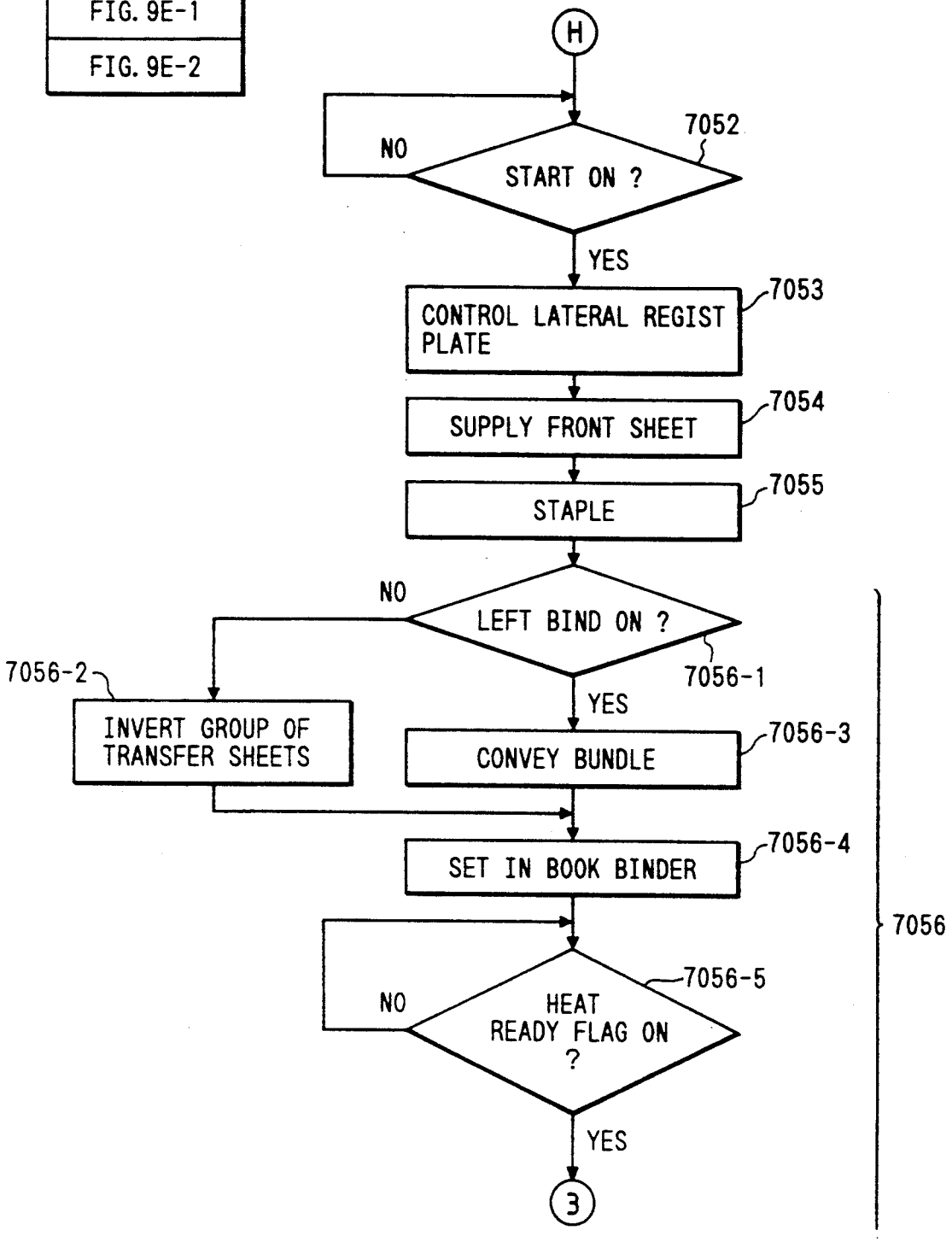
Figures 2, 9E:
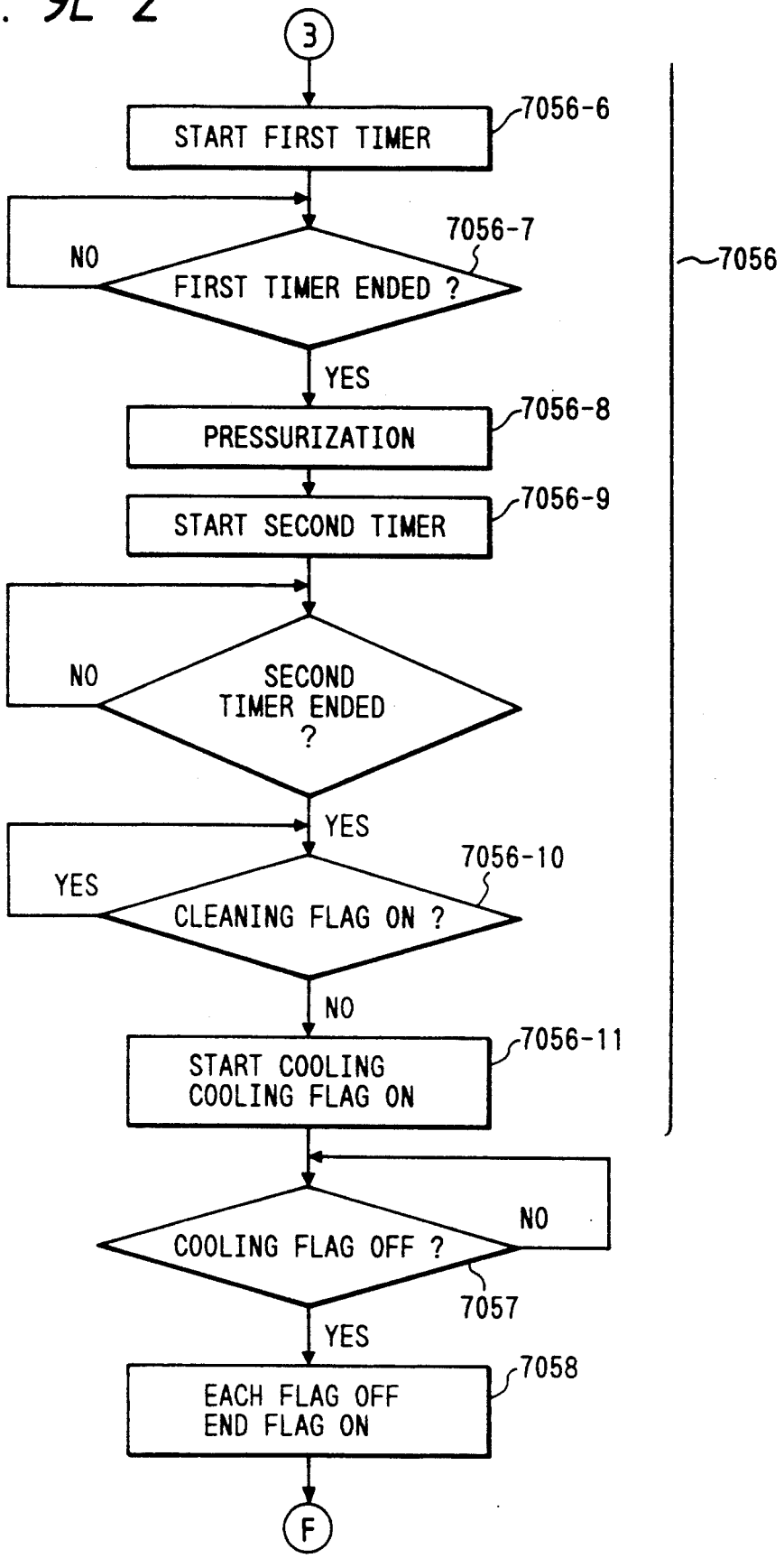
Figure 9F:
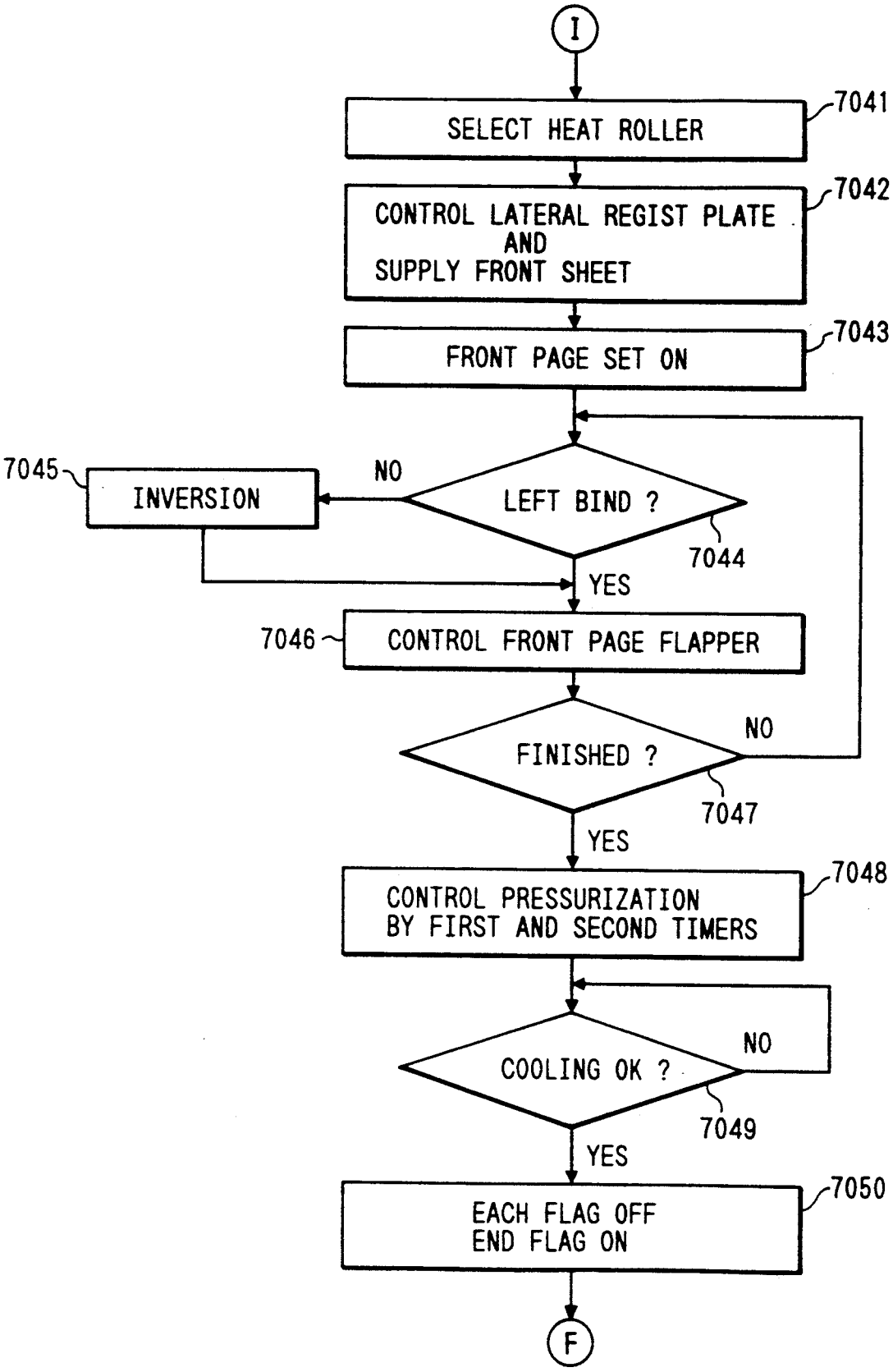

The manual mode command is detected in the order of step 7006, step 7051 (FIG. 9A), and step 7052 (FIG. 9E). Upon reception of a treatment start command signal from the copying machine main body 1000, the position control of the lateral registration plate is performed in step 7053 in the above-mentioned treatment sequence.

In step 7054, an A4-size front sheet is supplied from the upper front sheet cassette 2401 to the book binder 2503 on the basis of the received book bind information. In step 7055, the bundle of transfer sheets manually inserted on the temporary store bin are stapled.

After the book bind treatment and the cooling treatment (steps 7056-1 to 7056-11) are executed in the same manner as in the multiple copy book bind mode, the associated flags are turned off, and the end flag is turned on. The flow then returns to step 7003 in FIG. 9A to wait for the next operation command.

As described above, according to this embodiment, in the pressurizing control of the book binder 2503, the lateral registration plate 2504 is positioned to attain a distance as a sum of the total thickness of the bundle of transfer sheet and the front sheet and the margin $\alpha$, and the first heating operation is performed. Thereafter, the lateral registration interval is decreased to pressurize the transfer sheets, and the second heating treatment is performed. Thus, adhesion properties and uniformity of gluing between the bundle of transfer sheets and the front sheet can be improved.

Figure 4:
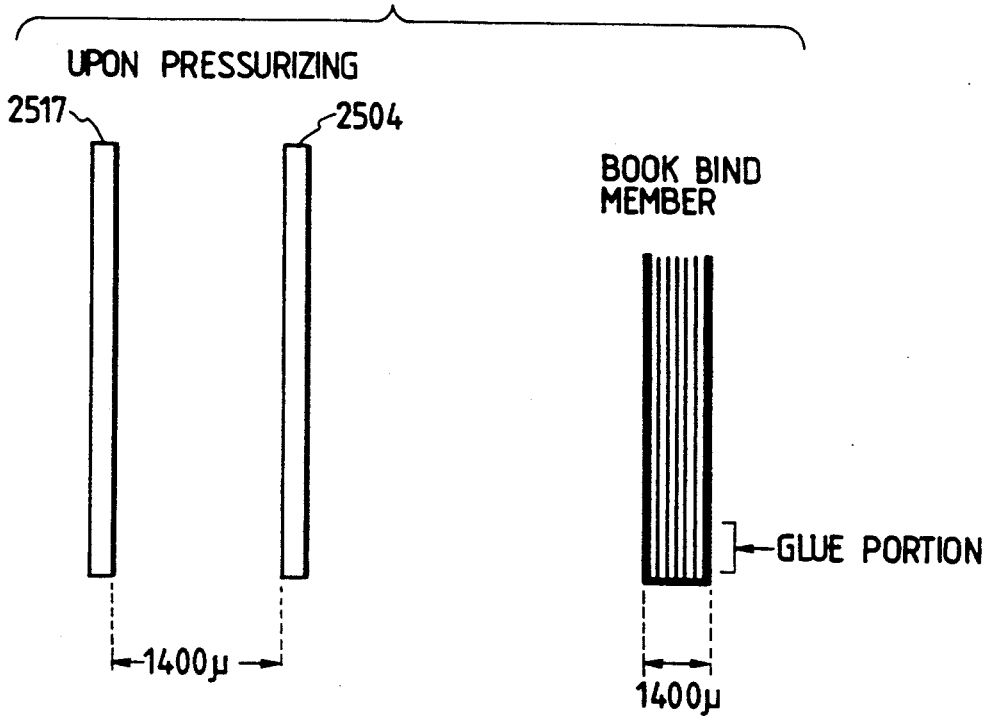
FIG. 4 is an explanatory view showing a book bind pattern according to the embodiment of the present invention.
Figure 5:
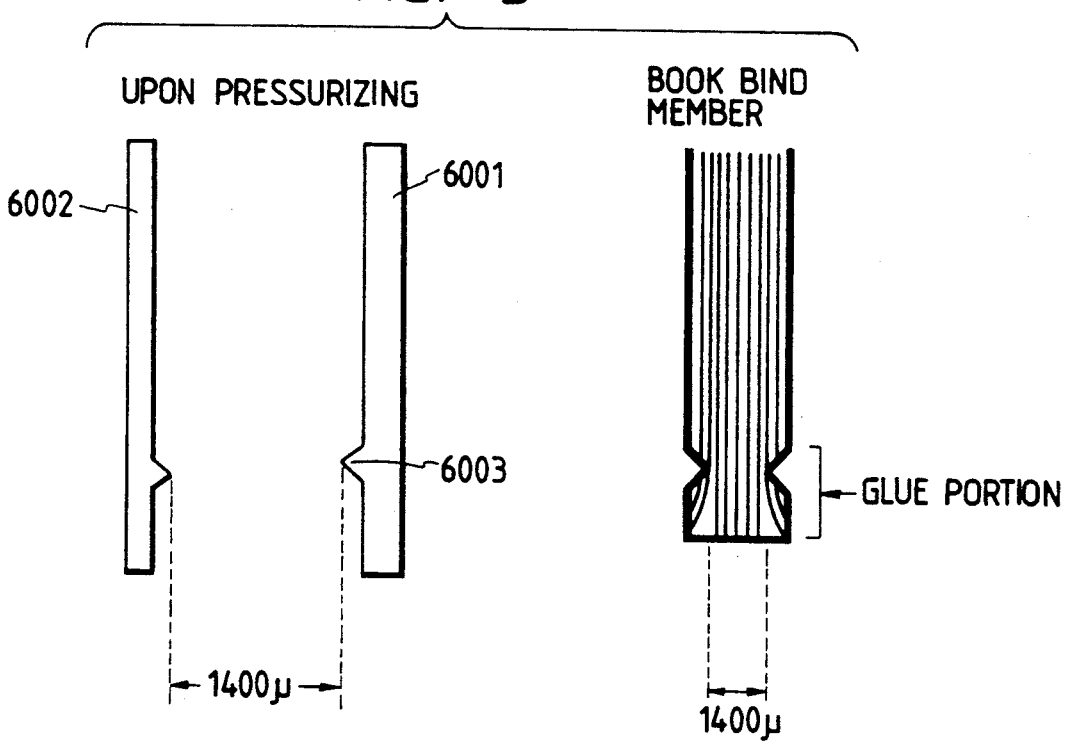
FIG. 5 is an explanatory view showing another book bind pattern according to the embodiment of the present invention.

In this embodiment, the surfaces of the lateral registration plate 2504 and the lateral registration abutment plate 2517 are formed to be flat, as shown in FIG. 4. However, as shown in FIG. 5, when projection-like pressurizing members 6003 are formed on a lateral registration plate 6001 and a lateral registration abutment plate 6002, adhesion properties between a front sheet and transfer sheets can be further improved.

(iv-B) Other Operations

The second embodiment of the present invention will be described below. In this embodiment, in the book bind device 2000, the convey paths are selected so that transfer sheets are discharged a plurality of times to the book bind unit 2500 via the tray 2300.

In FIG. 2, the single/multiple flapper 2109 is normally set to cause transfer sheets to travel toward the second convey path 2102 of the first convey unit 2100. Therefore, transfer sheets discharged from the main body are conveyed to the exclusive tray (temporary store bin) 2300. When the CPU 3001 compares original sheet number information in reception data with a predetermined value and detects that there are a large number of original sheets (step 8100), the original sheets are sorted on the exclusive tray 2300, and are stacked on the temporary store bins 2301 to 2305 as bundles of transfer sheets.

After the bundles of transfer sheets stacked on the temporary store bins 2301 to 2305 are registered, they are fed into the first convey unit 2100.

Assuming that a copy of 100 transfer sheets are to be bound, if a bundle of 100 sheets are stacked on the temporary store bin 2301 at a time to be simultaneously fed into the first convey unit 2100, it is difficult to perform conveyance, registration, and the like. Thus, if the number of sheets to be stacked on each bin is represented by P, the total number of transfer sheets is represented by N, and the number of bins in the book bind device is represented by n, $P=N/n$ is determined, and transfer sheets are sequentially stacked on the temporary store bins 2301 to 2305 in the order named in units of the predetermined numbers of sheets, e.g., 20 sheets (steps 8101 and 8101'). The transfer sheets are divided as described above, and are fed in turn to the book bind unit 2500 via the first convey unit 2100 in units of those stacked on each bin (steps 8102, 8103, 8104, and 8103). In this manner, a copy of 100 transfer sheets which are sequentially conveyed in units of 20 sheets are bound. For this purpose, in the first convey unit 2100, the convey direction of the re-supply flapper 2110 is switched according to an instruction from the CPU 3001, and the bundle of transfer sheets are conveyed to the third convey path 2104.

The bundle of transfer sheets conveyed to the third convey path 2104 are directly conveyed to the fourth convey path 2105 by the reverse flapper 2111 in a left bind mode, or are conveyed to the single copy convey path 2103 by the reverse flapper 2111 in a right bind mode. Thereafter, when a multiple copy reverse sensor 2113 detects the trailing end of the transfer sheets, the reverse roller 2108 is reversed to reverse the bind direction of the bundle of transfer sheets in the left bind mode, and the bundle of transfer sheets are conveyed to the fourth convey path 2105.

In the same manner as in the normal book bind operation described above, a front sheet corresponding to the size of transfer sheets, which is selected prior to conveyance of the bundle of transfer sheets is conveyed from one of the front sheet cassettes 2401 to 2403 to the book bind unit 2500 through the second convey unit 2200, and is set.

The bundle of transfer sheets conveyed to the fourth convey path 2105 are fed into the set front sheet, and are bound in the book bind unit 2500. After completion of the book bind operation, the bound bundle is cooled by the cooling unit 2600, and is discharged onto the book bind tray 2700. The same operation as described above is repeated for the bundles of transfer sheets stacked on the temporary store bins 2301 to 2305, and when all the bundles are discharged on the book bind tray 2700, the operation is ended.

As described above, when bundles of transfer sheets stacked on the temporary store bins in the book bind device are to be conveyed to the book bind unit, a bundle of a large number of transfer sheets are not transferred at a time, but are divisionally stacked on the bins. The transfer sheets are sequentially conveyed in units of divided bundles, thus assuring reliable conveyance of bundles.

The number of transfer sheets is judged by the CPU of the book bind device, and as shown in FIG. 12, the sheet number of the original in the reception data, i.e., the number of transfer sheets is compared with a predetermined value.

A treatment for, when the number of transfer sheets is small, directly transferring a bundle of transfer sheets from the copying machine to a heating device without going through the exclusive tray 2300 and binding this bundle will be described below. In the following description, the number of copies of transfer sheets to be formed in the copying machine main body is "1", and the number of original transfer sheets is "5".

Before the first page of transfer sheets discharged from the copying machine main body is conveyed to the post-processing device 2000, a front sheet matching with the size of the selected transfer sheet/front sheet is supplied from one of the front sheet cassettes 2401 to 2403, and is conveyed to the front sheet supply path 2204.

In this embodiment, A4-size front sheets are set in the front sheet cassette (upper) 2401, B5-size front sheets are set in the front sheet cassette (intermediate) 2402, and A3-size front sheets are set in the front sheet cassette (lower) 2403. Since an A4-size transfer sheet is selected in the copying machine main body, a front sheet in the front sheet cassette (upper) 2401 is conveyed to a front sheet supply path 2031 via an upper front sheet supply path 2010.

Since the sheet supply flapper 2205 is preset in a direction of the book binder 2503 when the front sheet is conveyed, the A4-size front sheet conveyed to the front sheet supply path 2204 is fed into and set in the book binder 2503.

On the other hand, a transfer sheet discharged from the copying machine main body is conveyed into the book bind device 2000. When the sheet number of an original is smaller than a predetermined value, the single/multiple flapper 2109 is set to allow a transfer sheet to travel along the first path 2101 and the single copy path 2103 in FIG. 2 upon an instruction from the CPU 3001 which executes the control sequence shown in FIG. 10. For this reason, the transfer sheet travels not in a direction of the second path 2102 but in a direction of the first path 2101 and the single copy path 2103. As a result, a convey path directly connected to the book binder is selected.

When the right bind mode is selected, since the reverse flapper 2111 is set to allow a transfer sheet to directly travel toward the fourth path 2105, the transfer sheet travels immediately downward.

Meanwhile, when the left bind mode is selected, since the reverse flapper 2111 is set to allow a transfer sheet to travel toward the third path 2104, the transfer sheet travels toward the third path 2104. When the transfer sheet travels along the third path 2104 and a single copy reverse sensor 2112 arranged in the third path 2104 detects the trailing end of the transfer sheet, the reverse flapper 2111 is switched from the third path 2104 to communicate with the fourth path 2105.

Since a second convey motor 2107 for driving the reverse roller 2108 and a convey roller in the third path 2104 is rotated in a direction opposite to a rotational direction so far, the rotational directions of the reverse roller 2108 and the convey roller in the third path 2104 are reversed. As a result, the transfer sheet conveyed to the third path 2104 travels in the reverse direction, escapes from the third path 2104, and is then conveyed in a direction of the fourth path 2105 under the restriction of the reverse flapper 2111. In this manner, in the left bind mode, the transfer sheet is conveyed to the fourth path 2105 in a state opposite to that in the right bind mode by utilizing the reverse flapper 2111 and the third path 2104.

The sheet supply flapper 2205 is arranged at an end portion of the fourth path 2105, and its flapper angle can be finely varied by a motor (not shown). The sheet supply flapper 2205 supplies transfer sheets to specific positions so that they are arranged in order in a front sheet already set in the book binder 2503.

Since the first page of transfer sheets is to be supplied now, in the right bind mode, the sheet supply flapper 2205 is set to the right so that the transfer sheet is fed to the rightmost side in FIG. 2. When a treatment for the first page of transfer sheets is completed, and a treatment for the second and subsequent pages of transfer sheets is to be started, since the direction of the sheet supply flapper 2205 is gradually changed to the left in FIG. 2, the second page of transfer sheets is located on the left side of the first page of transfer sheets. In this manner, the transfer sheets are set in order. In the left bind mode, since the direction of the sheet supply flapper 2205 is gradually changed from the leftmost state in FIG. 2 to the right in accordance with the number of transfer sheets, the second page of transfer sheets is located on the right side of the leftmost first page of transfer sheets.

When the above-mentioned operations are repeated, the five transfer sheets are fed into the front sheet set in the book binder 2503 in order according to the left or right bind mode. Upon completion of conveyance of transfer sheets, a book bind operation is performed in the book bind unit 2500. When the book bind operation is completed, the bound bundle is cooled by the cooling unit 2600, and is discharged onto the book bind tray 2700, thus completing the book bind operation for the number of copies of "1".

When a book bind operation for binding a bundle of sheets exceeding the predetermined value is selected in the copying machine main body, transfer sheets are stored on the temporary store tray 2300, and a convey path toward the book bind unit 2500 is then selected, as described above. Since the single/multiple flapper 2109 is set to convey transfer sheets discharged from the copying machine main body toward the second path 2102, the transfer sheets are conveyed to the exclusive tray (temporary store bins) 2300.

A required number of conveyed transfer sheets are sorted by the exclusive tray 2300, and are stacked on the temporary store bins 2301 to 2305 as bundles of transfer sheets. After the bundles of transfer sheets on the temporary store bins 2301 to 2305 are subjected to sheet registration, temporary binding treatment, and the like, they are then fed into the first convey unit 2100. In the first convey unit 2100, the re-supply path flapper 2110 is switched, and the bundle of transfer sheets are conveyed to the third path 2104. The bundle of transfer sheets conveyed to the third path 2104 are directly conveyed to the fourth path 2105 by the reverse flapper 2111 in the left bind mode. In the right bind mode, the bundle of transfer sheets travel toward the single copy path 2103 by the reverse flapper 2111, and when the multiple copy reverse sensor 2113 detects the trailing end of the transfer sheet, the reverse roller 2108 is rotated in the reverse direction. Thus, the bundle of transfer sheets are reversed to a direction opposite to that in the left bind mode, and are conveyed to the fourth path 2105.

Before each bundle of transfer sheets are conveyed from the first convey unit 2100 to the book bind unit 2500, a front sheet matching with the size of the transfer sheet/front sheet selected in advance is supplied from one of the front sheet cassettes 2401 to 2403, and is set in the book bind unit 2500 via the second convey path 2200. When the bundle of transfer sheets conveyed to the fourth path 2105 are fed into the front sheet, they are bound in the book bind unit 2500, and the bound bundle is discharged onto the book bind tray 2700 after it is cooled by the cooling unit 2600 upon completion of the book bind operation. The same operations are repeated for the bundles of transfer sheets stacked on the temporary store bins 2301 to 2305. When all the bound bundles are discharged onto the book bind tray 2700, the operation is ended.

As described above, when the number of transfer sheets is small, the fourth convey path is arranged to directly transfer the transfer sheets to the heating device. Thus, the transfer sheets can be bound without going through convey paths for other bundles, and a book bind treatment time can be shortened.

What is claimed is:

1. A book bind device comprising:

supply means for supplying a front sheet used in a book bind operation of a plurality of sheet members;

convey means for conveying the sheet members;

book bind means for performing a book binding operation by coupling a front sheet supplied by said supply means and the sheet members conveyed by said convey means.

said book bind means including clamp means for clamping the front sheet and the sheet members; and control means for receiving an information signal representing a thickness of the front sheet and the sheet members, and for controlling the clamping interval of said clamp means on the basis of the information signal.

2. A device according to claim 1, wherein said supply means has front sheet storage means for storing front sheets, and means for guiding a front sheet stored in said front sheet storage means toward said book bind means.

3. A device according to claim 2, further comprising a plurality of said front sheet storage means which are arranged in accordance with the types of front sheets stored therein, and which can be selectively used according to the type of sheet members supplied by said supply means.

4. A device according to claim 1, wherein said book bind means has heat means for melting glue applied to the front sheet.

5. A device according to claim 1, wherein said book bind means has discharge means for discharging the bound plurality of sheet members outside said device.

6. A book bind device comprising:

first convey means for conveying a plurality of sheet members;

deposit means for temporarily storing the sheet members conveyed by said first convey means, said deposit means having a plurality of support members each of which supports the sheet members;

supply means for supplying a front sheet used in a book bind operation of the sheet members;

second convey means for conveying the sheet members in said deposit means; and book bind means for performing the book binding operation by coupling the front sheet supplied by said supply means and the sheet members conveyed by said second convey means.

7. A device according to claim 6, wherein said supply means has front sheet storage means for storing front sheets and means for guiding a front sheet stored in said front sheet storage means toward said book bind means.

8. A device according to claim 7, further comprising a plurality of said front sheet storage means which are arranged in accordance with the types of front sheets stored therein, and which can be selectively used according to the type of sheet members supplied by said supply means.

9. A device according to claim 6, wherein said book bind means has heat generating means for melting a glue applied to the front sheet.

10. A device according to claim 6, wherein said book bind means has discharge means for discharging the bound plurality of sheet members outside said device.

11. A book bind device comprising:

supply means for supplying a front sheet used in a book bind operation of sheet members;

first convey means for conveying a plurality of sheet members;

deposit means for temporarily storing the plurality of sheet members conveyed by said first convey means;

temporary bind means for temporarily binding the plurality of sheet members stored in said deposit means;

second convey means for conveying the plurality of sheet members bound by said temporary binding means; and book bind means for performing the book binding operation by coupling the supplied front sheet and the plurality of sheet members.

12. A device according to claim 11, wherein said supply means comprises front sheet storage means for storing front sheets used in the book bind operation of the sheet members and third convey means for conveying the front sheet stored in said front sheet storage means to said book bind means.

13. A device according to claim 11, wherein said temporary binding means comprises a staple device.

14. A device according to claim 1 or 6, wherein said book bind means comprises:

clamp means for clamping the front sheet and the plurality of sheet members conveyed by the corresponding convey means;

heat means for heating twice the front sheet and the plurality of sheet members clamped by said clamp means; and control means for pressurizing the front sheet and the plurality of sheet members by decreasing a clamping interval of said clamp means during a second heating by said heat means to be shorter than that during a first heating.

15. A device according to claim 14, wherein said control means is adapted to receive an information signal representing a thickness of the front sheet and the plurality of sheet members, and varies the clamping interval of said clamp means on the basis of thickness information of the received information signal.

16. A device according to claim 14, wherein said clamping means has a projection member on a surface thereof which is in contact with the front sheet.

17. A device according to claim 6 or 11, wherein said deposit means comprises a sorter for sorting and depositing a plurality of bundles of sheet members, the deposited bundles of sheet members being sequentially conveyed in units of bundles.

18. A device according to claim 1, 6 or 11, further comprising reverse means for reversing leading and trailing ends of a sheet member.

19. A device according to claim 6 or 11, wherein said deposit means has an open portion so that a plurality of sheet members can be externally placed thereon.

20. A device according to claim 6 or 11, further including:

third convey means for conveying the plurality of sheet members discharged from said image forming unit to said book bind means; and a flapper for selectively switching said first convey means and said third convey means in accordance with an external command signal.

21. A device according to claim 20, wherein when the number of sheet members is larger than a predetermined value, said flapper selects said first convey means, and when the number of sheet members is smaller than the predetermined value, said flapper selects said third convey means.

22. A device according to claim 11, further including control means for receiving information representing the number of sheet members transmitted from said image forming means, for, when the number of sheet members represented by the information is larger than a predetermined value, causing said temporary binding means to bind the sheet members in units of predetermined numbers of sheets, and causing said second convey means to convey the sheet members bound in units of the predetermined numbers of sheets.

23. An image forming apparatus comprising:

image forming means for forming an image;

supply means for supplying a front sheet used in a book bind operation of a plurality of sheet members;

convey means for conveying the sheet members discharged from the image forming means; and book bind means for performing the book binding operation by coupling the front sheet supplied by said supply means and the sheet members conveyed by said convey means, said book bind means including clamp means for clamping the front sheet and the sheet members; and control means for receiving an information signal representing a thickness of the front sheet and the sheet members, for controlling the clamping interval of said clamp means on the basis of the information signal.

24. An image forming apparatus comprising:

image forming means for forming an image;

first convey means for conveying a plurality of sheet members discharged from said image forming means;

deposit means for temporarily storing the sheet members conveyed by said first convey means, said deposit means having a plurality of support members each of which supports the sheet members;

supply means for supplying a front sheet used in a book bind operation of sheet members;

second convey means for conveying the sheet members in said deposit means; and book bind means for performing the book binding operation by coupling the front sheet supplied by said supply means and the sheet members conveyed by said second convey means.

25. An image forming apparatus comprising:

image forming means for forming an image;

supply means for supplying a front sheet used in a book bind operation of sheet members;

first convey means for conveying a plurality of sheet members discharged from an image forming unit;

deposit means for temporarily storing the plurality of sheet members conveyed by said first convey means;

temporary bind means for temporarily binding the plurality of sheet members stored in said deposit means;

second convey means for conveying the plurality of sheet members bound by said temporary bind means; and book bind means for performing the book binding operation by coupling the supplied front sheet and the plurality of sheet members.

26. A book bind device according to claim 1, said clamp means performs a clamping operation when the front sheet and the plurality of sheet members are inserted therein.

27. A book bind device according to claim 1, wherein said clamping means has a projection member on a surface thereof which is in contact with the front sheet.

28. A sheet bind device according to claim 4, wherein said heat means heats the front sheet and the plurality of sheet members from a lower side thereof.

29. A sheet bind device according to claim 28, wherein said heat means is shiftable between a heating position and a retracted position, wherein said heat means shifts to the retracted position after the binding operation to discharge the plurality of bound sheet members.

30. A sheet bind device according to claim 29, further comprising means for folding the front sheet into a U-Shaped configuration on a bottom portion of which the adhesive is coated.

31. A book binding device, comprising:

conveying means for conveying a plurality of sheet members;

supply means for supplying a front sheet used in a book bind operation of the sheet members, said supply means including a plurality of front sheet storage means in which different types of front sheets are stored;

book bind means for performing the book binding operation by coupling the front sheet supplied by said supply means and the sheet members supplied by said convey means; and control means for controlling said supply means to selectively supply a front sheet from said front sheet storage means corresponding to the type of sheet members conveyed by said convey means.

32. An image forming apparatus comprising:

image forming means for forming an image convey means for conveying a plurality of sheet members discharged from said image forming means;

supply means for supplying a front sheet used in a book bind operation of the sheet members, said supply means including a plurality of front sheet storage means in which different types of front sheets are stored;

book bind means for performing the book binding operation by coupling the front sheet supplied by said supply means and the sheet members conveyed by said convey means; and control means for controlling said supply means to selectively supply a front sheet from said front sheet storage means corresponding to the type of sheet members conveyed by said convey means.

* * * * *

UNITED STATES PATENT AND TRADEMARK OFFICE

CERTIFICATE OF CORRECTION

PATENT NO. 5,240,362

DATED August 31, 1993

INVENTOR(S) Tomobumi NAKAYAMA, et al.

It is certified that error appears in the above-indentified patent and that said Letters Patent is hereby corrected as shown below:

Column 1
Line 21, "originals," should read --original,--.

Column 4
Line 20, "whose,.edge" should read --whose edge--,
Line 40, "U-shaped" should read --U-shape--.

Column 8
Line 18, "i" should read --is--.

Column 9
Line 46, "a" should read --an--.

Column 15
Line 38, "001" should read --3001--.

Column 19
Line 55, "means." should read --means,--.

Column 22
Line 16, "mem" should read --mem- --,
Line 51, "sheet" should read --book--,
Line 54, "sheet" should read --book--,
Line 60, "sheet" should read --book--,
Line 65, "conveying means" should read --convey means--.

Column 23
Line 16, "image" (second occurrence) should read --image;--.

UNITED STATES PATENT AND TRADEMARK OFFICE

CERTIFICATE OF CORRECTION

PATENT NO. 5,240,362

DATED August 31, 1993

INVENTOR(S): Tomobumi NAKAYAMA, et al.

It is certified that error appears in the above-indentified patent and that said Letters Patent is hereby corrected as shown below:

On drawing

Sheet 9

Fig. 7C, "SAQUENCE" should read --SEQUENCE--.

Sheet 15

Fig. 9A-2, "REATMENT" should read --TREATMENT--.

Signed and Sealed this

Third Day of May, 1994

Bruce Lehman

*Attest:*

BRUCE LEHMAN

*Attesting Officer*

*Commissioner of Patents and Trademarks*